US008033624B2

(12) United States Patent
Silva et al.

(10) Patent No.: US 8,033,624 B2
(45) Date of Patent: Oct. 11, 2011

(54) SYSTEM AND METHOD FOR PRINTING A CONTINUOUS WEB EMPLOYING A PLURALITY OF INTERLEAVED INK-JET PENS FED BY A BULK INK SOURCE

(75) Inventors: Stephen E. Silva, Walthan, MA (US); Peter J. Wood, Amherst, NH (US); John M. Fiske, Winchester, MA (US); Cadman E. Rozea, Sudbury, MA (US)

(73) Assignee: Lasermax Roll Systems, Inc., Burlington, MA (US)

( * ) Notice: Subject to any disclaimer, the term of this patent is extended or adjusted under 35 U.S.C. 154(b) by 621 days.

(21) Appl. No.: 11/782,316

(22) Filed: Jul. 24, 2007

(65) Prior Publication Data

US 2009/0027449 A1 Jan. 29, 2009

(51) Int. Cl.
*B41J 3/00* (2006.01)

(52) U.S. Cl. ..... 347/4; 347/42; 347/40; 347/41

(58) Field of Classification Search ..... 347/4
See application file for complete search history.

(56) References Cited

U.S. PATENT DOCUMENTS

| | | | | |
|---|---|---|---|---|
| 5,428,375 | A * | 6/1995 | Simon et al. | 347/12 |
| 5,562,351 | A * | 10/1996 | Uematsu | 400/68 |
| 5,961,228 | A * | 10/1999 | Ward et al. | 400/120.16 |
| 5,967,394 | A * | 10/1999 | Crowley et al. | 226/31 |
| 6,336,718 | B1 * | 1/2002 | Blanchard et al. | 347/84 |
| 7,011,388 | B2 * | 3/2006 | Lodal et al. | 347/33 |
| 7,278,699 | B2 * | 10/2007 | Drake et al. | 347/13 |
| 2002/0105571 | A1 | 8/2002 | Izawa et al. | |

(Continued)

FOREIGN PATENT DOCUMENTS

| | | |
|---|---|---|
| EP | 0903232 A2 | 3/1999 |

(Continued)

*Primary Examiner* — Matthew Luu
*Assistant Examiner* — Brian Goldberg
(74) *Attorney, Agent, or Firm* — William A. Loginov, Esq.; Loginov & Associates, PLLC

(57) ABSTRACT

This invention provides a system and method for printing continuous web and feeding ink to printing pens (or cartridges) that employs an array of interleaved ink-jet pens that are arranged to receive bulk ink through a manifold. The manifold and pens are mounted on a fixed array suspended over the web feed path. The manifold includes a plurality of self-sealing quick-disconnect couplings that each serve a discrete ink-jet pen. The pens lay down ink in a registered manner across the full width of the web. The pens are organized into two parallel, multi-pen arrays that are each diagonally oriented with respect to the feed direction. The feed path allows for duplex printing with a second web-side's array located on a lower level of the device, generally beneath the first-side's array. Duplex printing is facilitated due to its inherent length of the feed path. The printed part of the web is free of contact over predetermined lengths that ensure sufficient time for the drying of ink. Each pen is interconnected with a connection to a respective manifold that maintains a vacuum so as to prevent seepage of ink from the pen nozzles. The vacuum is maintained by a draw pump, while ink is continuously provided to the manifold via a float switch in a pressure regulator. The regulator is fed by a bulk ink supply using a feed pump. A check-valve standpipe on each manifold assists in removing any trapped air from the system, thus assisting in maintaining the vacuum.

14 Claims, 20 Drawing Sheets

U.S. PATENT DOCUMENTS

| | | | | |
|---|---|---|---|---|
| 2002/0122093 | A1* | 9/2002 | Otsuka | 347/40 |
| 2004/0246294 | A1* | 12/2004 | Mitsuzawa | 347/23 |
| 2005/0001877 | A1 | 1/2005 | Chikanawa et al. | |
| 2007/0059083 | A1* | 3/2007 | Silverbrook et al. | 400/614 |
| 2007/0153035 | A1* | 7/2007 | Jung et al. | 347/9 |

FOREIGN PATENT DOCUMENTS

| | | | |
|---|---|---|---|
| EP | 1063096 | A2 | 12/2000 |
| EP | 1586451 | A1 | 10/2005 |

* cited by examiner

SYSTEM AND METHOD FOR PRINTING A CONTINUOUS WEB EMPLOYING A PLURALITY OF INTERLEAVED INK-JET PENS FED BY A BULK INK SOURCE

BACKGROUND OF THE INVENTION

1. Field of the Invention

This invention relates to devices for printing a continuous web and more particularly to devices that print using ink-jet pens.

2. Background Information

Electronic inline printing and processing of a continuous web of paper has become ubiquitous in recent years for a variety of purposes and industries. Such industries include publishing and "print-on-demand," direct mail marketing, billing and the like. Typically, a web is directed from a large stand-mounted roll to one or more high-speed (typically greater than 100 pages per minute) electronic printers that deposit and fuse toner to the web. The web is then directed to further processing units that variously print, emboss, cut, sort, stack and fold the web, among other possible processes.

It is often desirable to apply a color heading, logo, decoration or other device to the web either before or after the electronic printer has applied toner print. One technique for applying variable colored printing is to employ a color toner print engine. Such engines typically employ one or more individual toner sources that feed one or more image-transfer elements. The image transfer elements lay the toner onto the web and fuse it via heating. However, this approach uses expensive color toner and may be prone to speed and reliability limitations.

A more efficient and cost-effective technique to applying colored print is to employ a so-called "ink-jet" pen or "cartridge." The ink jet cartridge defines an ink source contained within a unitary housing. The ink source is an impelled fluid that is dispensed as droplets at a print head located at the bottom end of the cartridge (also referred to as a pen) through a microscopic gridwork of nozzles that define the print pixels of the cartridge. The nozzles are individually addressed through a print controller so that they dispense ink at an appropriate time with respect to the movement of the printing media (paper, etc.).

In a conventional ink-jet printer, the nozzle grid is relatively small (less than one-inch square), and the printing media is driven through the printer at a rate that allows the cartridge(s) to traverse the width of the media on a motorized carriage so as to provide a print line of a given thickness. In general, the cartridge's inherent speed of ink deposition and the carriage speed both serve to limit the throughput rate of the print media. This throughput rate is typically significantly slower that 100 pages per minute. Hence, a conventional ink-jet printer with traversing head(s) is seldom suitable for providing color print to a high-speed moving web.

In addition, the internal ink supply of even the largest, commercial ink-jet cartridge is relatively small, requiring cartridges to be frequently replaced and/or manually refilled. The replenishment of ink/cartridges would, thus, prove inconvenient and time-consuming for a large production run—particularly where only a small number of cartridges on a traversing carriage are used.

Accordingly, it is highly desirable to provide a system and method for applying color print to a high-speed moving web that is efficient and low maintenance. This system and method should allow for large production runs without requiring replenishment and should allow variable printing across the entire width of a web without halting the feed of the web. The system and method should support printing in a large array of possible colors that may be combined on a single web when desired.

SUMMARY OF THE INVENTION

This invention overcomes disadvantages of the prior art by providing a system and method for printing continuous web that employs an array of interleaved ink-jet pens that are arranged to receive bulk ink through a manifold. The manifold and pens are mounted on a framework in groups of imagers suspended over the web feed path. The manifold includes a plurality of self-sealing quick-disconnect couplings that each serve a discrete ink-jet pen. The pens are also interconnected with a data connector that provides clock signals from a controller also interconnected with the web feed drive. In this manner, the pens lay down ink in a registered manner across the full width of the web. In an illustrative embodiment, the pens are organized into two parallel, multi-pen arrays that are each diagonally oriented with respect to the feed direction. The feed path allows for duplex printing with a second web-side's array located on a lower level of the device, generally beneath the first-side's array. Each level of the device maintains the flatness of the web using a vacuum surface comprising a plurality of holes in communication with a vacuum source. Duplex printing is facilitated due to the inherent length of the feed path. The printed part of the web is free of contact over predetermined lengths that ensure sufficient time for the drying of ink, typically achieved through a combination of absorption into the paper and some evaporation into the atmosphere.

A set of optional, movable, spot-printing ink-jet arrays can be located in an imager units that ride on carriages, which are movable in a widthwise direction. These movable arrays include an ink-feed mechanism for bulk ink and appropriate quick-disconnect couplings for ease of cartridge/pen replacement. In an illustrative embodiment, the movable arrays can be interconnected to a system for determining/reporting the widthwise location of the array. Each fixed array or group of movable arrays is interconnected with a discrete quick-change manifold that defines a channel in communication with a plurality of dripless quick-disconnect couplers. The couplers allow the feed tubes of individual cartridges/pens to be attached and detached for servicing, color change, etc. Each manifold is fed by a pressurized supply of bulk ink provided by a sealed ink bag via a pump and a pressure regulator. The pressure regulator includes a bleed valve. The manifold is also connected to a vacuum sensor assembly having a check valve that communicates with a vacuum sustaining draw pump. The draw pump withdraws excess ink and maintains the needed negative pressure to prevent ink from seeping out of pen nozzles.

Each manifold receives ink via a regulator tank that maintains a predetermined ink level using a float switch. The level falls as ink is drawn and the switch activates the bulk-ink-supply feed pump to restore the level. A headspace containing air resides above the ink, with a small pinhole to allow for air replacement as the level rises and falls, but most air is unchanged and saturated with ink vapor to prevent ink-dry-out. Each manifold also includes a standpipe that exhausts any air bubbles present in the manifold's supply of ink through a check valve arrangement. The standpipe is in communication with a connection from the vacuum sustain pump. The vacuum sustain pump also connects to a downstream waste tank with an overflow sensor. Any ink flushed through the vacuum sustain line is exhausted in the waste tank. A variety of other level sensors at various locations in the ink-feed fluid circuit are used to monitor levels and detect failures to feed/clogs. The ink controller uses this information to control the pumps and/or issue alarm/stop signals to the printer controller and operator. Also, the use of quick-disconnect fittings, removable manifolds/pens, and peristaltic pumps with removable wetted elements, makes changing ink colors on the fly possible and relatively easy to accomplish.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
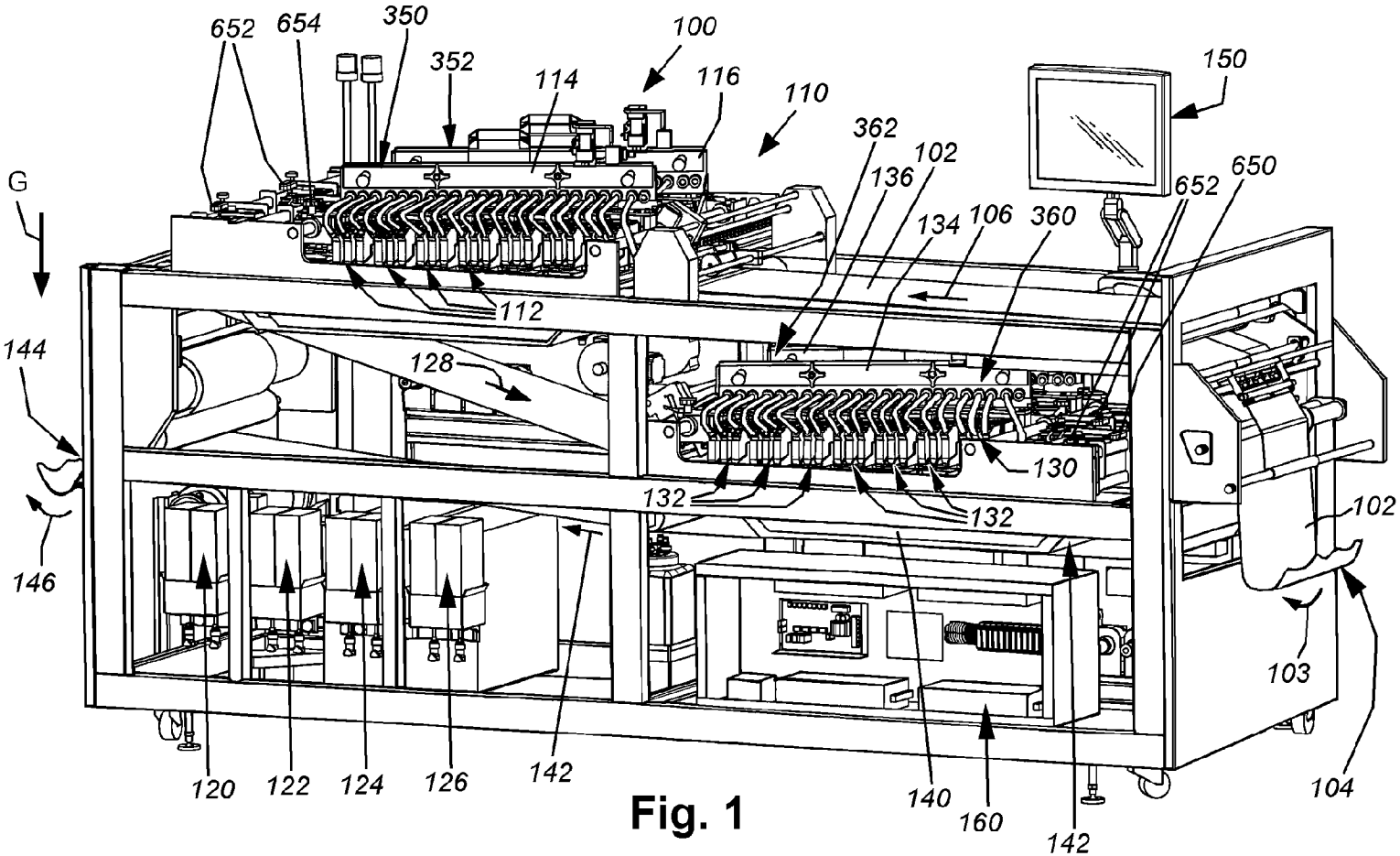
FIG. 1 is a perspective view of a system for printing a continuous web using a plurality of interleaved fixed-position ink-jet pens according to an illustrative embodiment of the invention.

FIG. 1 illustrates a multi-ink-jet pen printer 100 adapted to feed a high-speed continuous web 102. The web 102 is fed (arrow 103) from a sensing loop 104 that is maintained at a predetermined size range by a driven roll stand (not shown) or other utilization device as the web 102 is drawn into the printer 100. The web 102 is directed downstream (arrow 106) to an upper printing fixed array 110 where the exposed top side of the web is printed via an array of interleaved ink-jet pens 112. As described further below, a group of pens is fed continuously by a respective manifold 114, 116 that receives bulk ink from each of a plurality of interconnected ink boxes/bags 120, 122, 124 and 126. The boxes/bags include one or more standard or custom ink colors that are adapted to be distributed through the ink-jet pens 112 via their electronically controlled nozzles.

The web 102 is fed (arrow 128) from the upper printing array 110 to a lower printing fixed array 130 that supports a second array of pens 132, fed by respective manifolds 134 and 136. Both the upper and lower printing arrays direct ink downwardly (in the direction of gravity (G) However, the lower printing array 130 faces the opposing web face due to the (approximately) 180-degree turn in the web path following the upper printing array 110.

Downstream of the lower printing fixed array 130, the web path again turns 180 degrees and passes over the bottom surface 140 of a lower vacuum box 142 (described below) and downstream (arrow 242) toward the outlet 144, where the web can be directed (arrow 146) to a further processing device (e.g. a printer, cutter, folder, stacker and/or inspection station, etc.). The multi-turn arrangement of web feed can be alternately termed a "Z-pattern" herein.

The printer 100 includes a display/user interface 150, which may be a touch screen, or it may include a separate keyboard, mouse, etc. The interface enables the operator to monitor and control the operation of the print process. The display also provides indications for such parameters as web speed, ink level, pen status, and other information of importance to the user. The control circuitry and power supply components 160 for the printer are located beneath the lower printing array 130 in this example.

Figure 2:
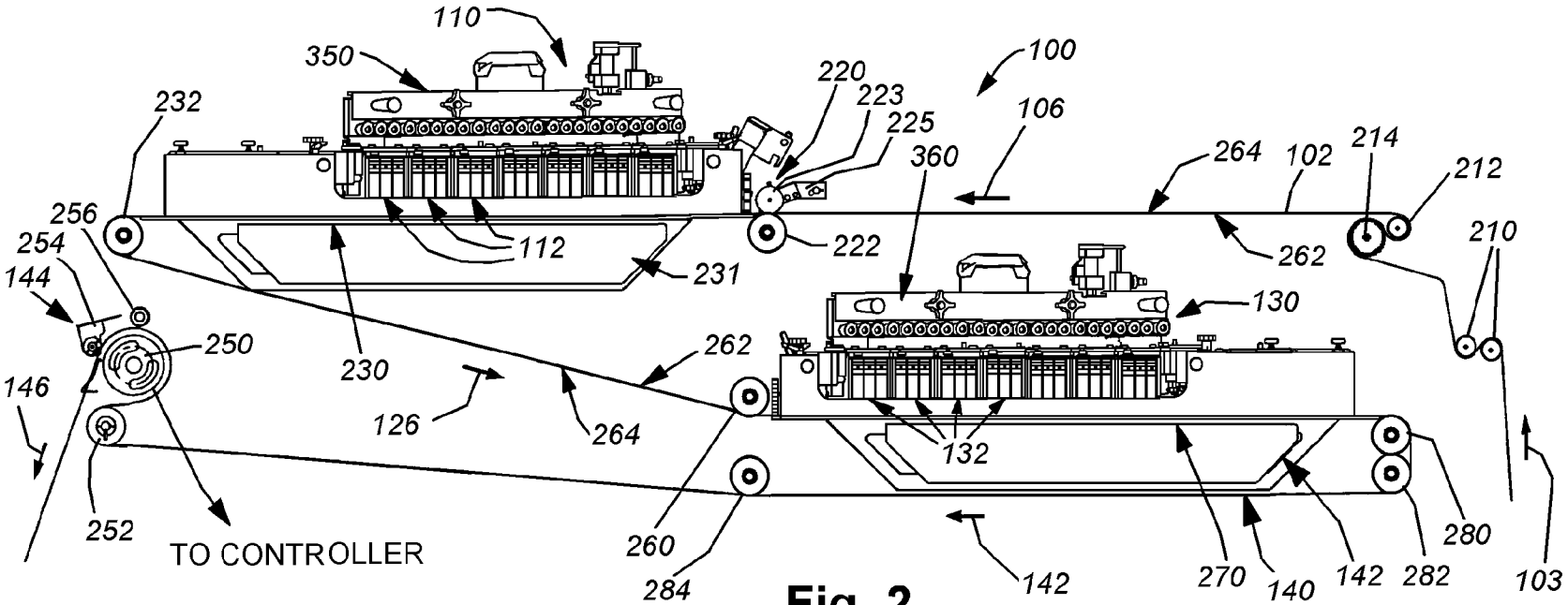
FIG. 2 is a side view of the feed path defined by a continuous web passing through the system of FIG. 1.
Figure 3:
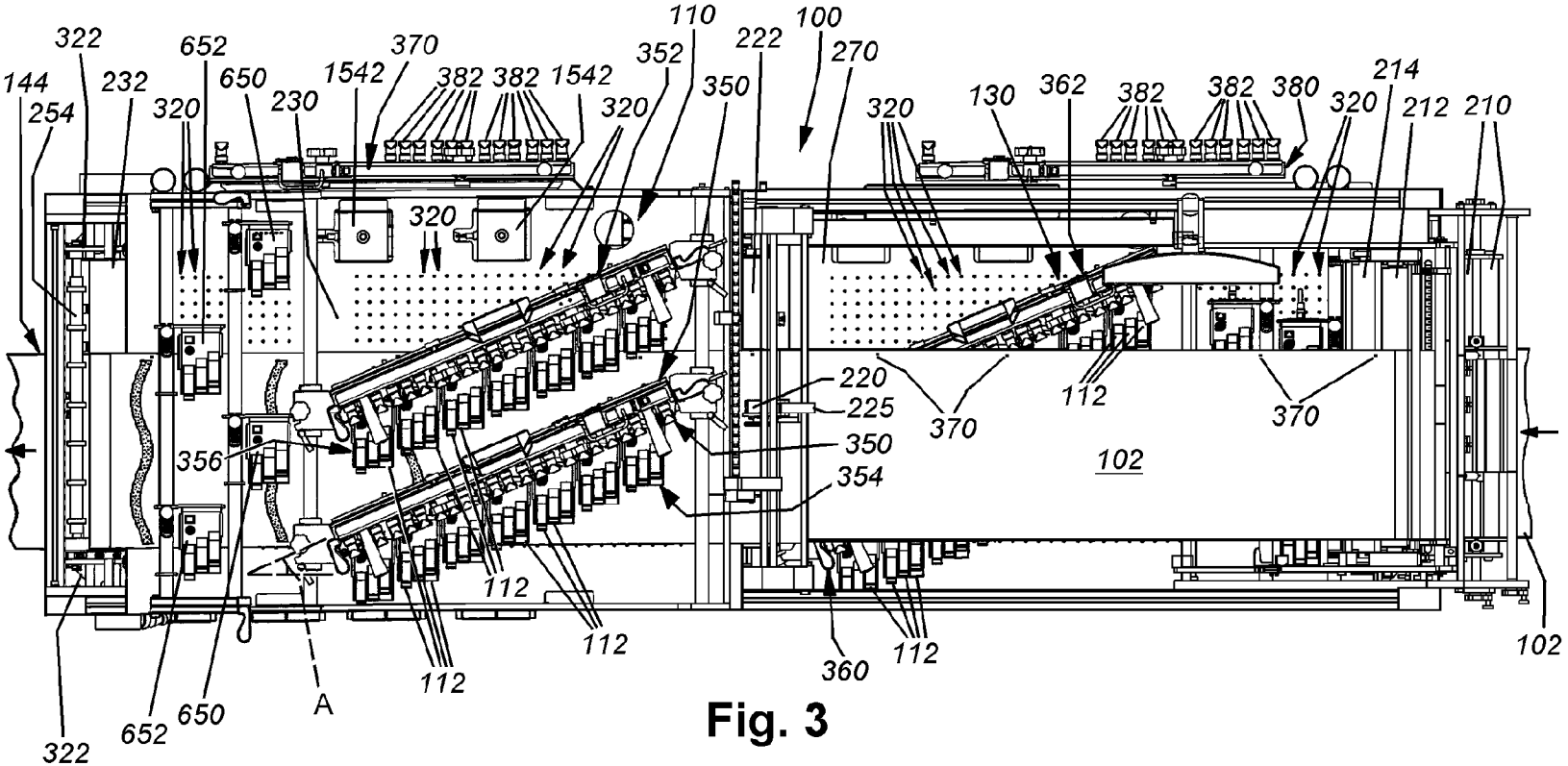
FIG. 3 is a top view of the system of FIG. 1 including an exemplary continuous web.

The web feed path is shown in further detail in the simplified side view of FIG. 2 in which certain printer housing elements have been omitted, and with further reference to the more-detailed top view of FIG. 3. The web 102 enters the printer 100 through a series of guide bars 210 and a braking roll 214 and nip roll 212 pair that maintain lateral positioning of the web and provide drag-induced tension against the drawing pull of the drive roller 250 (described further below). This tension ensures accurate registration of the web as it moves through the printer and generally prevents billowing of the web and its associated feed loop. From the input braking roll 214, the web travels along a table surface to the upper printing array 110. At the upstream end of the array 110, an encoder wheel assembly 220 provides tracks the movement of the input web as it enters the array 110. This arrangement allows for accurate registration of the web with respect to the printing arrays. The lower roller 222 of the encoder assembly 220 forms a nip relative to a movable nip roller 223 that can be mounted on bearings for ease of movement. This undriven nip roll 223, and others employed along the path, can include an elastomeric or metallic surface as appropriate. The nip roll 223 is mounted on a retractable support 225 for easy thread-up of the printer.

In another embodiment, it is contemplated that a braking/torque roller can be located at or near the position of the encoder wheel assembly 220, just upstream in the path of travel from the upper array 110. This would allow for tensioning of the web closer to the actual print region of the printer.

The web 102 is further stabilized by a vacuum feed surface 230 of an upper vacuum box 231. The surface 230 is defined by a plurality of small diameter ports (ports 320 in FIG. 3) across the surface 230 that interconnect to a vacuum source. The vacuum ports 320 maintain a light vacuum draw on the web 102 that maintains its flatness as it passes beneath the pens 112 of the array 110. The web 102 in this embodiment passes around a non-driven 180-degree turn roller 232. In this embodiment, the web 102 is essentially pulled through the entire length of the path by a central drive roller 250 interconnected to a central drive motor that operates the motor in response to a controller (within the circuit section 160, for example) so as to maintain appropriate registration between the web and the pens. The registration aspect of the printer is described further below. The web enters the drive roller via a full-width idler roller 252. A freewheeling nip roller 254 pressurably bears against the drive roller (which includes an elastomeric surface for high-friction contact with the web, such a urethane). The nip roller can be moved out of contact with the drive roller 250 for servicing and initial thread-up of the web by a pair of swiveling end brackets 322 (FIG. 3). A guide bar 256 resides above the drive roller to assist with thread-up and provide lateral stability to the web. It can include movable edge guides in various embodiments. While in this embodiment, the web is pulled at the output 144 through the feed path, it is expressly contemplated that web drive (or a plurality of drives) can be located at alternate locations, such as adjacent to one or both of the printing arrays 110 and 130.

The web, hence, passes through the turn roller 232 and down a substantially unsupported incline section to an undriven input roller that contacts the new upper side 262 of the web. This is, in fact, the lower side the web.102 as it is initially input to the printer 100, but, by turning at the roller 232 it is now the upper side. The initial upper side 264 is now the lower side. This new lower (initially upper) side 264 enters the lower printing array in contact with a vacuum feed surface 270 while the former lower side 262 faces the lower array of pens 132. Thus, the initial lower side is now printed, thereby affording duplex printing that is applied to both web sides 262, 264 in turn. The web exits the array and passes through a pair of vertically stacked undriven 180-degree turn rollers 280, 282 that allow the web to span the gap defined by the lower vacuum box 142 so that the web passes without resistance along the lower box surface 140. Another undriven guide roller 284 supports the long run of web 102 between the lower turn roller 282 and the drive roll idler 252.

Notably, the uncontacted span of web between the upper turn roller 232 and the lower vacuum surface 270 allows time for the first (upper) printed web side 264 to dry before it comes into contact with the surface 270 or any other component. Otherwise, the ink would smear, degrading print quality. Conventional, commercially available water-based ink-jet inks exhibit finite dry times that are influenced by primarily by absorption into the paper print media together with some exposure to air. When sufficient exposure time has elapsed, the ink is sufficiently dry for handling. The uncontacted distance is set so that, at the chosen feed rate, the web has an uncontacted period sufficient to enable handling of the selected ink. In one embodiment a span of 2-3 feet (approximately 1 meter) is sufficient for a web traveling at 60-100 standard pages per minute. Other drying-span lengths are expressly contemplated in connection with the use of different inks and/or web feed speeds.

Likewise, the opposing, second printed side 262 passes out of the lower array 130 and remains uncontacted over the entire length of the printer 100. While less length is needed in most embodiments, the relative long length provided by the embodiment ensures complete drying of both sides prior to downstream handling. In alternate embodiment, the lower uncontacted span can be shortened or again turned to exit form the same side as entry. A variety of other feed path arrangements are contemplated in alternate embodiments. Such path arrangements should allow for appropriate drying of applied ink on a given web side. This is generally achieved through lack of contact with the web by any surface during the specified drying interval. In addition, while a full-duplex printer is shown and described, the concepts employed herein can be applied to a half-duplex printer, applying ink to only one side of the web.

Having described the path, FIG. 3 is discussed further in connection with the general mounting and layout of printing pens. A depicted, the individual pens 112, which are each commercially available, self-contained ink-jet cartridges with controllable nozzles re arranged on a pair of manifold/mounting assemblies 350, 352 (upper assemblies) and 360, 362 lower assemblies that collectively comprise respective pen arrays 110 and 130. The overall assemblies each define a linear structure in this embodiment. Each axis line of the structure extends at an acute angle A with respect to the downstream direction as shown. In this embodiment, the angle A is between approximately 15 and 40 degrees, however, the exact angle is determined by the printing width of each pen (taken perpendicular to the downstream direction) and the overall width desired to be printable. The adjacent assemblies have equal numbers of cartridges/pens (21 each in this embodiment) and each cartridge/nozzle in an array is aligned with a corresponding cartridge/nozzle (along the upstream-to-downstream direction) in an adjacent assembly. In this embodiment, the maximum printable width can be between approximately 17 and 21 inches using 42 cartridges.

Two factors dictate the placement and angle of the individual pens. The first factor is the limited printing area of each individual nozzle. In general the nozzle is limited to a rectangular area of approximately ½ to ¾ inch by ½ to ¾ inch. As such, to print across an entire maximum width, a large number of nozzles must be arranged in a side-to side relationship. Also, each nozzle is attached to a cartridge that is wider and longer than the underlying nozzle. Thus, to accommodate an ink housing and mounting assembly, the cartridges cannot be simply arranged side-by-side across the width, as gaps between nozzles would ensue.

Rather, as shown, each cartridge is mounted in a respective assembly 350, 352, 360, 362 so that the nozzles are slightly spaced apart in the downstream direction but fully stitched together (and possibly, slightly overlapped) along the perpendicular widthwise direction. The long axis of each cartridge is, thus arranged along the widthwise direction to facilitate a minimal spacing between cartridges, thereby minimizing the upstream-to-downstream length of the overall pen assembly 350, 352, 360, 362. To further minimize the overall array (110, 130) length in the upstream-to-downstream direction to a manageable dimension, each array 110 and 130 is divided into two angled assemblies (350, 352 and 360, 362, respectively) as shown. Thus, the upstream-most (inboard) cartridge 354 of the pen assembly 350 has a nozzle that stitches together with (overlaps) the nozzle of the downstream-most cartridge 356 of the adjacent (side-by-side) array 352. The precise arrangement and number of individual assemblies in an array is highly variable. For example, in alternate embodiments, arrays can be disposed at opposing angles and/or at relative offsets in the upstream-to-downstream direction. As will be described in detail below, the arrangement of cartridges/nozzles in each array 110, 130 dictates a timed printing of each nozzle as a predetermined location on the web passes through each nozzle as it is fed downstream (in synchronization with the pixel clock encoder). The sequence of printing by each nozzle in an array is described further below. In one embodiment, the locations of the web are tracked, in part by equally spaced registration marks placed, for example, along the side edge of the web 102.

In one illustrative embodiment, both the top array 110 and bottom array 130 include an encoder wheel assembly 222, 260, respectively riding slip-free on the paper surface so that movement of the web through each array is monitored. Another embodiment can employ an encoder assembly within a roller closely engaged with the web. Each encoder generates a pulse based upon a predetermined length increment passing through the array. This pulse allows the printer's control system to accurately track the web as it moves through each array. The pulse further provides a pixel clock that is used by the cartridges to control printing. In addition, an optical "top-of-form" sensor can be provided to each array that senses when the beginning of a web or page length has passed a predetermined location relative to the array. In this embodiment, one imager 410 in each of the upper array 110 and lower array 130 receives the pixel clock and top-of-form signals, and thereby relays these signals to the other imagers in the respective array.

Optionally, an optical mark or symbol reader (not shown) located at one or more positions along the feed path, communicates with a controller to determine the current position of each web location. Internal and external encoders located for example on feed rollers and in the drive motor assembly can also track web movement. A basic system for tracking a web using registration marks and encoders is taught in U.S. Pat. No. 5,967,394, entitled METHOD AND APPARATUS FOR PINLESS FEEDING OF WEB TO A UTILIZATION DEVICE, the teachings of which are expressly incorporated herein by reference. In general, one sensor tracks movement of the web via reading of marks while the driving of the web is regulated by the drive motor of the printer 100, which can include a pulse encoder within its drive train. The location of a given increment of web with respect to a reference point (for example, the upstream-most nozzles in an array) is calculated by counting a preset number of pulses after reading of a mark. Since the length of an increment of web corresponding to each pulse is known, a certain number of pulses defines a known length travel of the web from the fixed point of the mark reader. Printing by each nozzle can occur in turn as the web moves a predetermined number of pulses, generally corresponding to the upstream-downstream spacing between each adjacent nozzle's leading edge.

Figure 4:
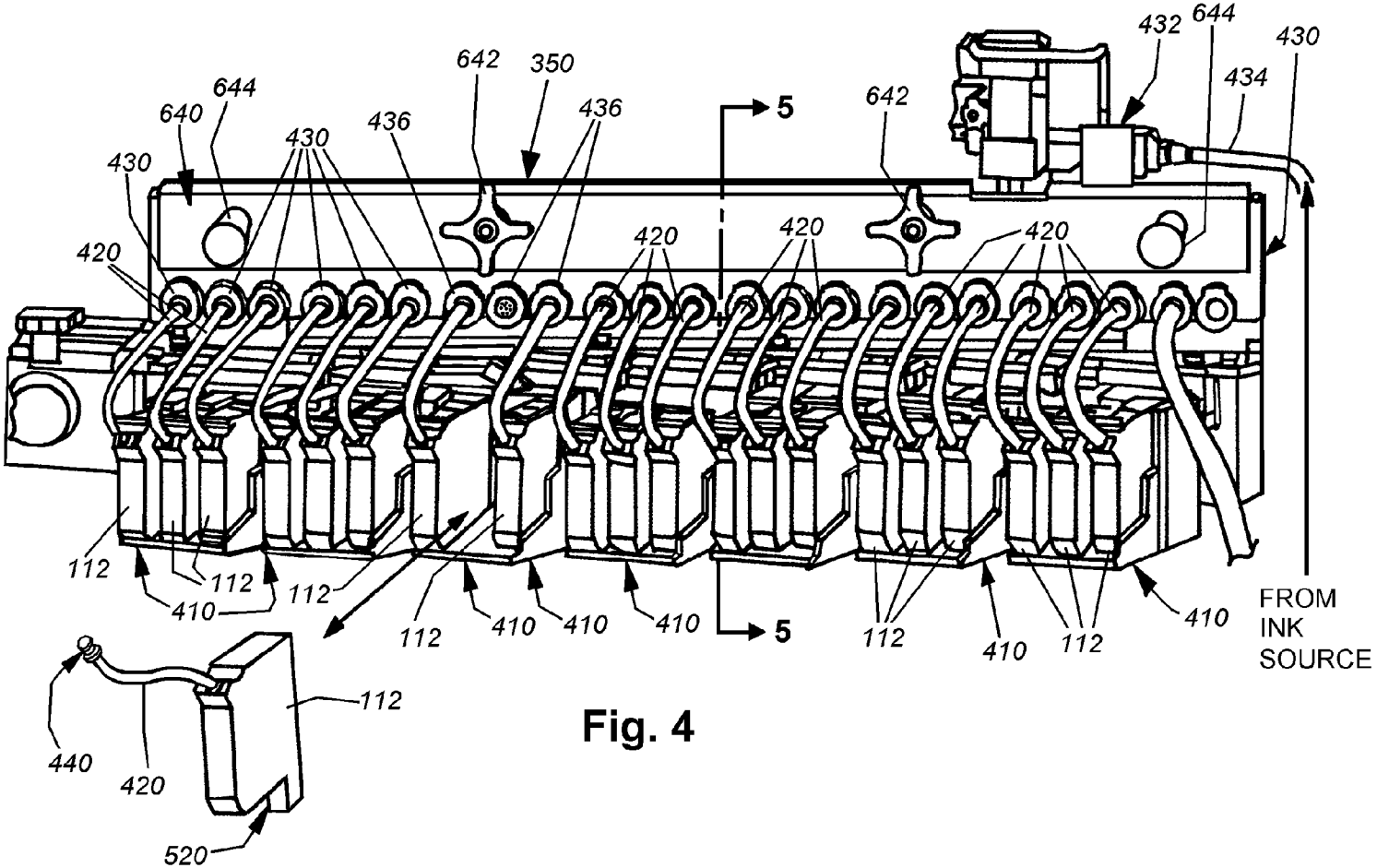
FIG. 4 is a more detailed perspective view of a single ink-jet cartridge manifold assembly of the system of FIG. 1.
Figure 5:
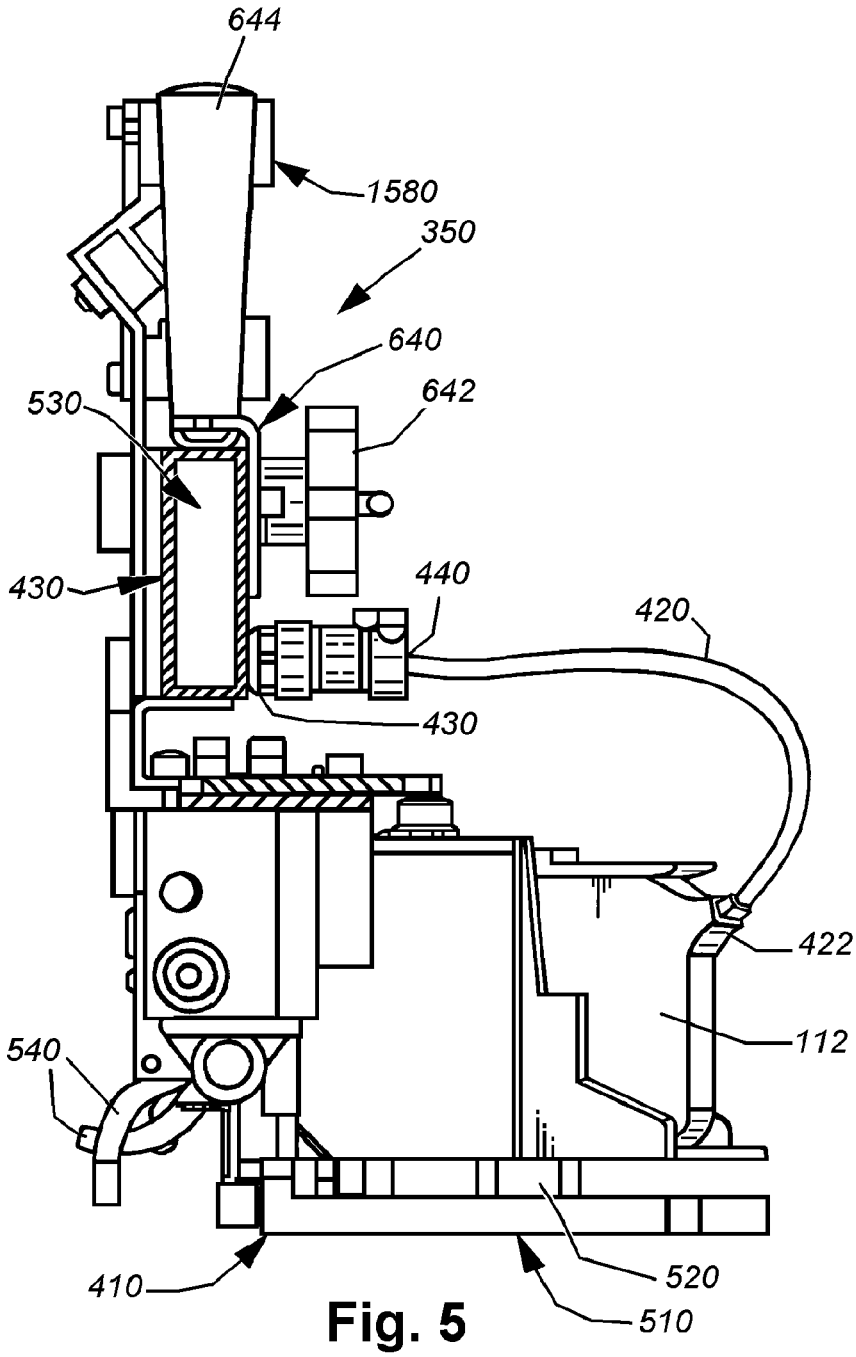
FIG. 5 is a side cross section taken along line 5-5 of FIG. 4.

Having briefly described the placement and orientation of cartridges in the fixed array further reference is made to on exemplary cartridge/pen assembly 350, shown in greater detail in FIGS. 4 and 5. Each cartridge 112 is mounted within one of seven three-cartridge mountings 410, each having a downstream length of approximately 4½ inches and a widthwise length of approximately 5½ inches. The mountings each define an independent "imager" that collectively receives data from the print controller and the pixel clock. The pens in the imager share a common data link (Ethernet, in this example) that provides print information), as well as a common DC power source and a data bus that provides pixel clock signals for print synchronization. The imagers are commercially available from the INC.JET company of Norwich, Conn. under the trade name "jet.engine." The cartridges 112 in this embodiment are based upon the Hewlett Packard thermal ink-jet system delivering resolution of up to 600×600 dpi at 137.5 feet per minute of web drive. Faster web drive speeds can be employed, but deliver proportionally lower resolution in the downstream/feed direction, as described below.

Notable, each three-cartridge mounting/imager 110 includes a transport mechanism with a base 510 (FIG. 5) that selectively uncovers the print nozzle 520. The base 510 can include an elastomeric surface that seals against the nozzle and that moves to cover and uncover the nozzle while slidably cleaning the nozzle surface using a squeegee effect. Appropriate motors and/or solenoids can be employed to effect base movement. An electrical and data connection 540 is provided to each imager 410. The data includes both print data to control the laying down of ink patterns and the pixel clock data to control timing of printing with respect to web movement. Print-control data is provided in a network-based format over an Ethernet connection. Each imager 410 is also provided with appropriate internal connections (not shown) for each cartridge 112. The connections facilitate operation of the individual nozzles at predetermined times within the print cycle.

Since a single cartridge contains, on average, only 800 ml of ink, its life in a production environment is highly limited. However, as the average life of a nozzle may exceed 2 million feet of print, the ink of a sealed cartridge is exhausted far faster than the nozzle's useful life. To more effectively equalize the nozzle's life with available ink supplies and support a desirable, relatively infrequent changing of cartridges, each cartridge is fitted with a permanently attached, low-impedance (under ten-inch long) feed tube 420 at a forward angled surface 422 of the cartridge that is readily accessible when the cartridge is locked into the imager mounting 410. The tube affords a continuous flow of ink into each cartridge from each of a plurality of base-mounted ink-supply-bags 120, 122, 124 and 126 (FIG. 1). The feeding and control of ink delivery are described in further detail below. To distribute ink to individual cartridges through tubes, each pen assembly 350 includes a box-shaped manifold 430 with a hollow manifold channel 530. The manifold chamber 530 receives bulk ink under the biasing action of the feeding system through an inlet assembly 432 that communicates with an inlet feed tube 434. The ink fills the manifold and is outlet through each of a plurality of connector ports 436. In this embodiment, the ports are self-sealing, dripless connections commercially available as NS4 Series Couplings from Colder Products Company, of St. Paul, Minn. The male coupling 440 is permanently attached to the cartridge lead tube 420. The male coupling includes appropriate (O-ring) seals and locking rims to generate a spring-loaded fitment with the corresponding manifold female connector port 436. The orientation of male and female connector parts can be reversed in alternate embodiments. Likewise, while a lead tube is attached to each cartridge for ease of attachment to the manifold, it is contemplated that the manifold can be fitted with lead tubes that mate with connectors mounted on associated cartridges. Likewise, both the manifold and cartridges can be provided with respective, permanently attached, mating tubes so that a connection is made midway on each tube along an overall feed tube structure. The tubing material employed in this embodiment is a low-gas-permeable urethane, which helps to reduce the amount of air drawn through the tubing wall as a result of the negative internal pressures (relative to atmospheric) within the feed system. A variety of comparable tubing materials can be employed in alternate embodiments.

The manifold ensures a highly uniform feed of the pens in the array due to the manifold's proportionately large-volume chamber, which can be internally shaped to be wider at the bottom than the top, to encourage the buoyant, upward migration of air bubbles to the ink/air-separation standpipe (1580 described in detail below) mounted to the top of the manifold. In this embodiment, each pen is connected by a relatively short run of tubing (approximately 10 inches or less) that is integrated with the respective pen. The relatively low flow-rate through the tubing, combined with the short run provides a low-impedance fluid circuit from the manifold to each pen. This eliminates any tendency for one pen in the array to "rob" ink from another pen due to a difference in draw rate or usage. This problem is more prevalent in ink systems that employ dedicated pressure regulators to feed multiple pens.

Figure 6A:
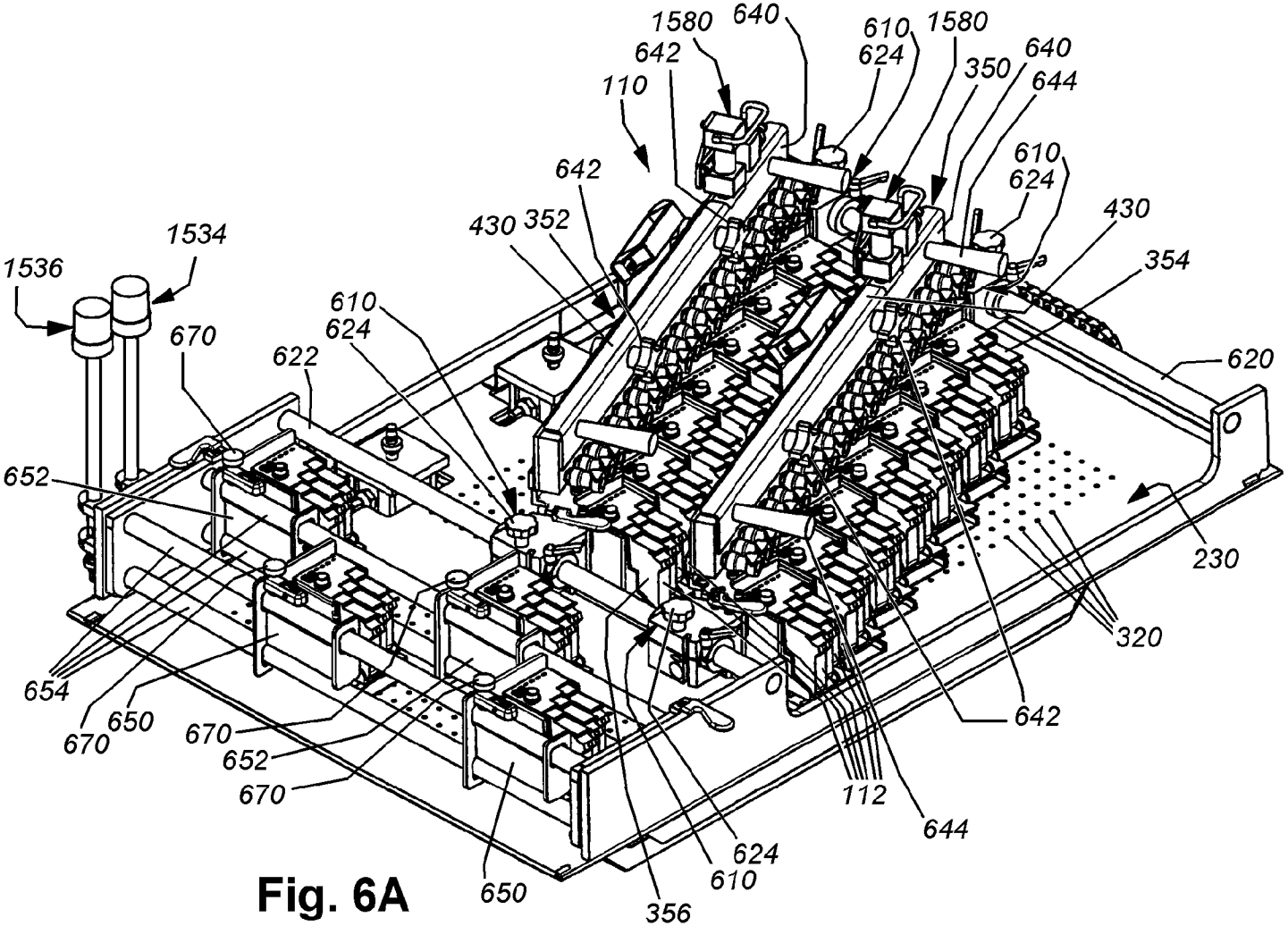
FIG. 6A is a fragmentary perspective view of the top printing section of the system of FIG. 1 with the manifold assemblies in a lowered, printing orientation.
Figure 6B:
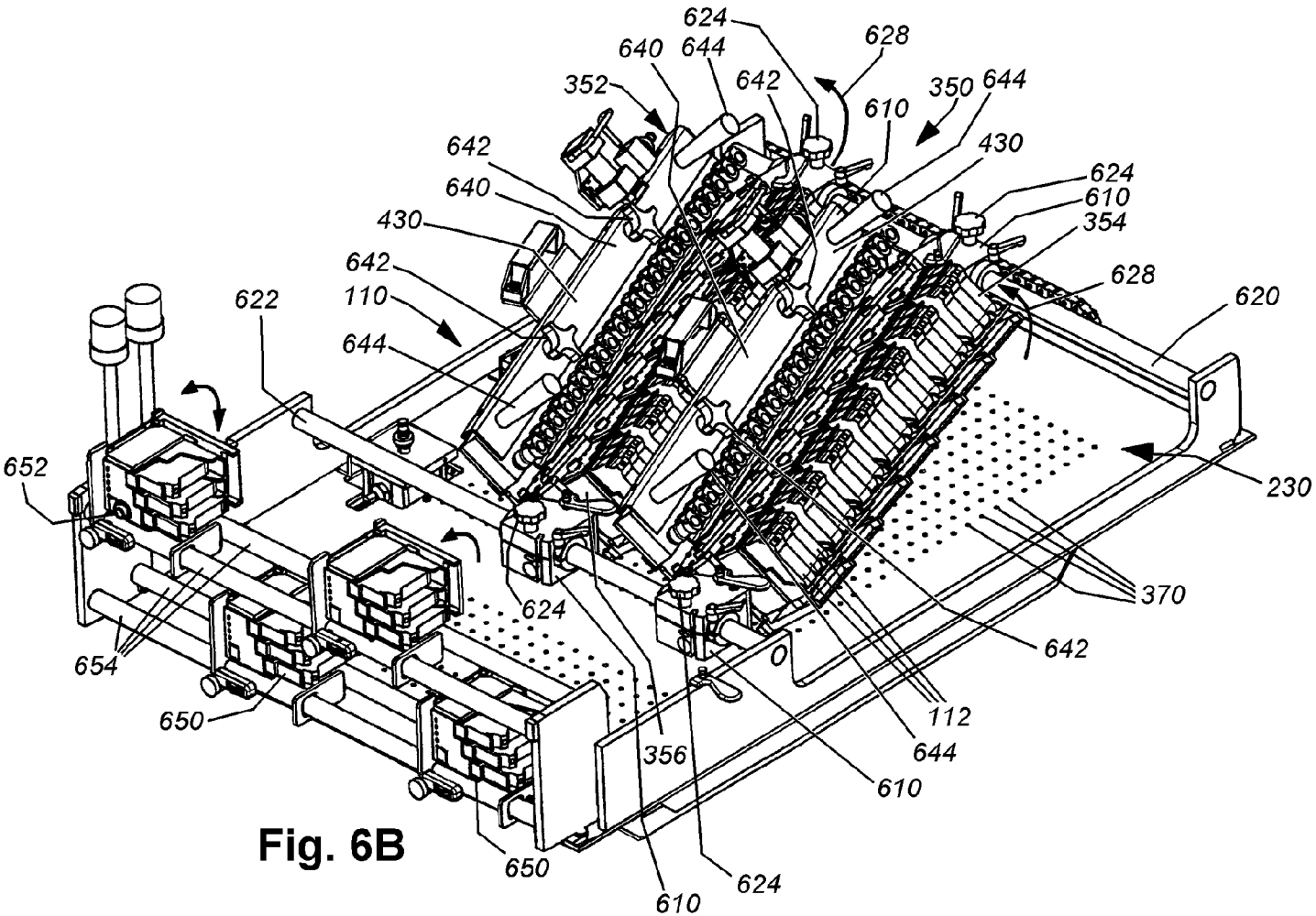
FIG. 6B is a fragmentary perspective view of the top printing section of the system of FIG. 1 with the manifold assemblies in a raised orientation.
Figure 7:
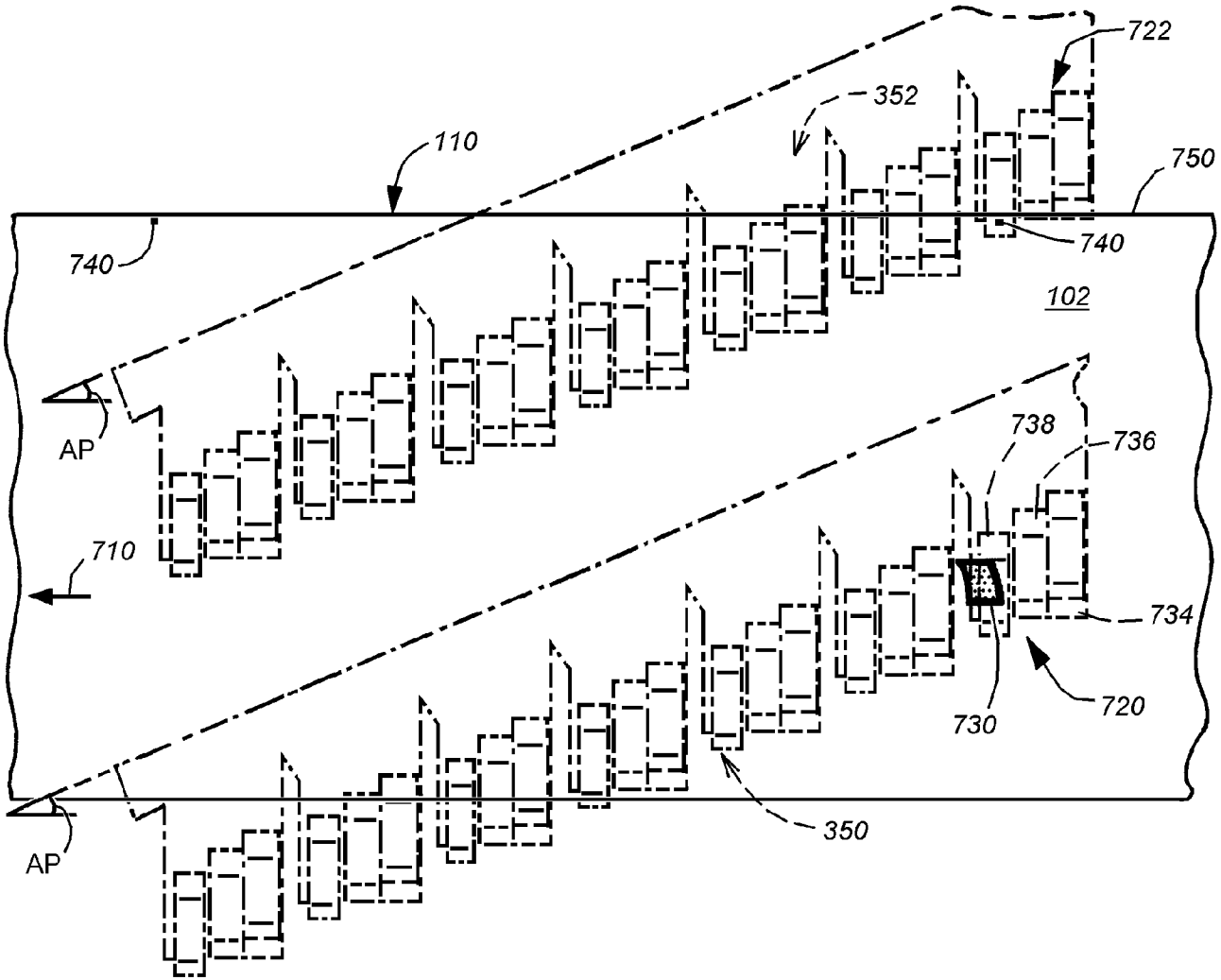
FIG. 7 is an exposed top view of a print run in process detailing the creation of first printed increment of an exemplary printed feature on a continuous web.

Referring now to FIGS. 6 and 7, in order to facilitate the loading of web, and the servicing of the device (cleaning, clear paper jams, etc.), each fixed and movable cartridge/pen assembly, 350, 352, 360, 362 is pivotally mounted on blocks 610 that can be adjusted in a widthwise direction by sliding along suspended rails 620, 622. The blocks 610 include locking knobs 624 to secure the assemblies 350, 352, 360, 362 in the appropriate widthwise orientation. This adjustability can be omitted in alternate embodiments or carried out using automated mechanisms known to those of ordinary skill. The assemblies pivot upwardly (arrows 628 in FIG. 6B) from a lowered position (FIG. 6A) in which the pens are ready to print the web, to a raised position (FIG. 6B) in which the underlying vacuum feed surface 230 is accessible. The blocks include additional locking handles, catches, and the like (as depicted) to allow the pen assemblies 350, 352, 360, 362 to be secured in either the lowered or raised position. Each assembly 350, 352, 360, 362 is separately pivotable in this embodiment, and to facilitate pivoting, includes a respective handle assembly 640, that is removable secured to the manifold 430 by turn screws 642 and includes a pair of handles 644. The handle assembly 640 and/or handles 644 can be widely varied or omitted in alternate embodiments. As shown, by way of example in FIGS. 6A and 6B, the handles 644 can project horizontally from the assembly 640 to lower the array's profile, or can project vertically, as shown in FIG. 4. The pivot mechanism used in this embodiment allow rapid movement of the assemblies out of a printing orientation without losing the relative position of the pens against the surface when they are replaced in a downward printing orientation.

Note that in various embodiments, the turn screws 642 can be used to detach the entire manifold from the underlying assembly frame. This facilitates more rapid changeout of the manifold when, for example a color change is needed. In general, the quick disconnects provided to each manifold render a color change relatively easy.

As detailed in FIGS. 6A and 6B, the device 100 also includes a separate set of spot-printing imagers 650 and 652 that are mounted downstream of each array 110, 130. In alternate embodiments these spot-printing imagers can be located upstream of the respective array. The spot printing imagers each consist of three interleaved (staggered) cartridges that produce an overlapping spot of printing in the same manner as the array imagers/cartridges. The imagers are mounted in two pairs, one more upstream (imagers 650) and one more downstream (imagers 652) to allow adequate clearance to create an unbroken, widthwise segment of printing with all imagers 650, 652. The imagers are mounted on rails 654 so that they can slide in a widthwise direction along the rails to enable them to be selectively positioned with respect to the web 102. Each imager 650, 652 includes an adjustment thumbwheels that can be operatively connected to a gear (not shown. The gear engages a rack (also not shown) in reach rail 654. This allows the individual imagers to be easily relocated on the respective rail along the widthwise direction. Note that the use of four imagers in two pairs is exemplary and more or fewer spot-printing imagers can be employed in alternate embodiments.

Notably, with reference also to FIG. 3, each set of four spot-printing imagers is fed bulk ink by a respective manifold 370 (for the upper array) and 380 (for the lower array). These manifolds can be similar or identical in construction to the array manifolds 430. Each cartridge in the respective spot-printing imagers 650, 652 is fed ink by appropriate dripless connectors 382 and feed tubes (omitted for clarity) that are identical to those used for the assemblies 350, 352, 360, 362. The imagers also respond to a data source and pixel clock to control printing in registration with the movement of the web 102. Like the assembly cartridges 112, the spot-printing imagers fire in turn as the appropriate section of web passes under their location.

To further illustrate the printing process reference is now made to the sequence of views shown in FIGS. 7-13 in which the web 102 is directed through the array 110, and under the cartridge assemblies 350, 352 to print an image that (by way of example) spreads across the entire width of the web. Note that the sequence described herein is performed substantially similarly or identically in the lower array 130 on the opposing web side. These assemblies are oriented at a non-perpendicular, diagonal (angle AP) with respect to the downstream, web feed direction (arrow 710) so that each cartridge print head in the array is located at an interleaved offset. As noted each set of three cartridges is commercially available with a predefined offset between heads. The overall group of imagers in the array maintain that degree of offset via the angle AP.

The print head of each cartridge is fired at the appropriate time to generate the complete image, based upon the pixel clock and tracked movement of the web 102. The imager 720 is shown in FIG. 7 forming the initial segment 730 of the full image as that portion of the web passes beneath it. Specifically each imager cartridge 734, 736, 738 is fired in turn in synchronization with the web movement to define the stitched, continuous print segment. The web may include tracking marks 740 that are preprinted to assist in web registration with respect to the arrays (employing an appropriate optical sensor in the device feed path. Alternatively, the array (or spot-printing imagers) can print such marks to assist in downstream tracking and handling of the web (both in this device 100 and in other post-production web-utilization devices). Note that the parallel imager 722 in the assembly 352 does not print as it resides beyond the adjacent edge 750 of the web 102.

Figure 8:
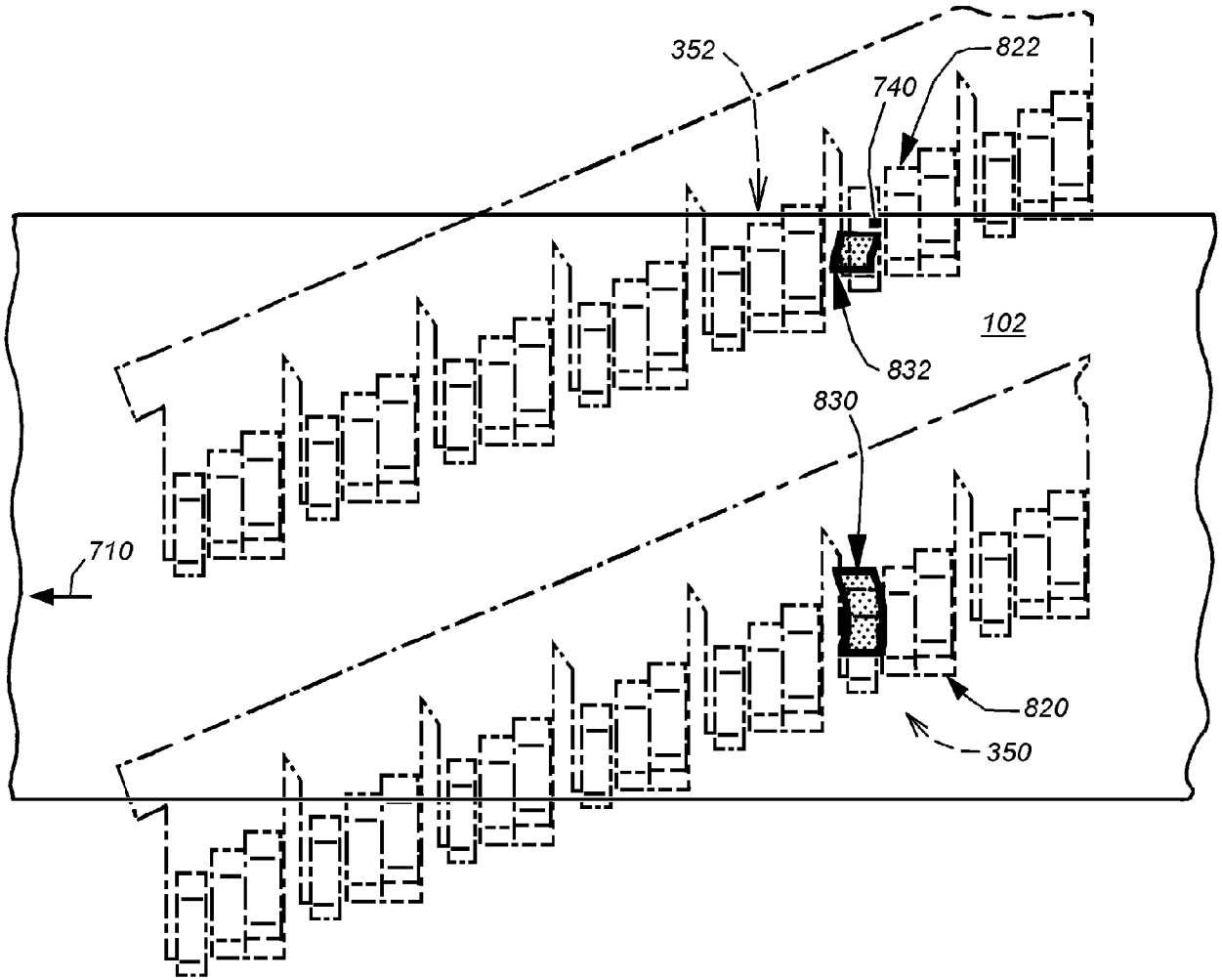
FIG. 8 is an exposed top view of a print run in process detailing the creation of second printed increment of the exemplary printed feature on a continuous web.
Figure 9:
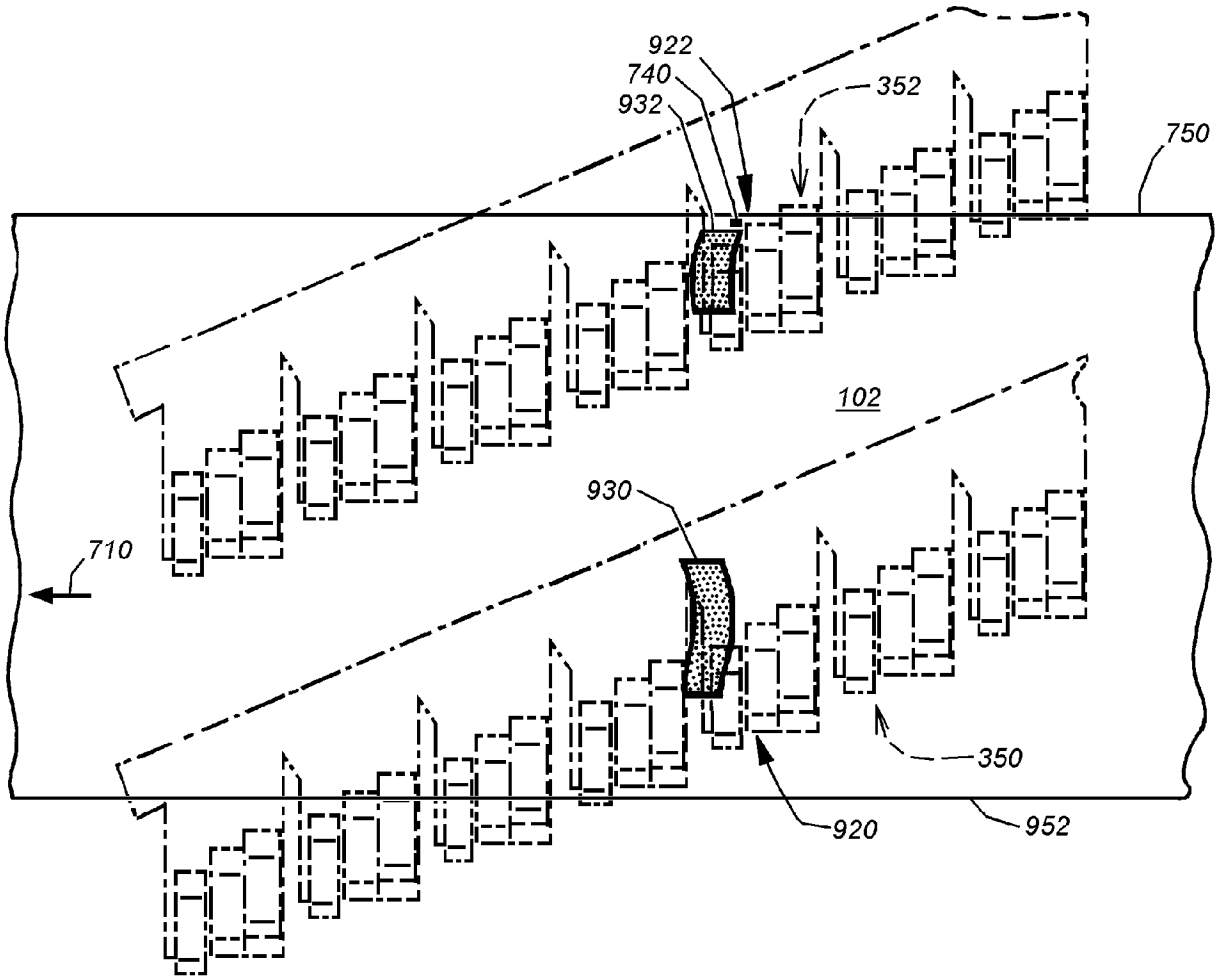
FIG. 9 is an exposed top view of a print run in process detailing the creation of third printed increment of the exemplary printed feature on a continuous web.

Referring to the next sequence view in FIG. 8, the web 102 moves further downstream (arrow 710), the next imager 820 in the assembly 350 adds to the growing print segment 830. Likewise, the opposing assembly's (352) parallel imager 822 now forms a segment 832 near the opposite edge of the web 102.

The sequence continues as parallel imagers 920 and 922 (FIG. 9) add to the segments 930, 932 respectively). Based upon the angular orientation of the two assemblies 350 and 352, the segment 932 grows across the web from the web edge 750 toward the center, while the segment 930 grows from the center toward the opposite web edge 952. It is expressly contemplated that the array can be compose of more than two assemblies of imagers and/or these assemblies can be arranged in any packing order so long as the device logic fires the appropriate print heads in conjunction with the proper location on the web.

Figure 10:
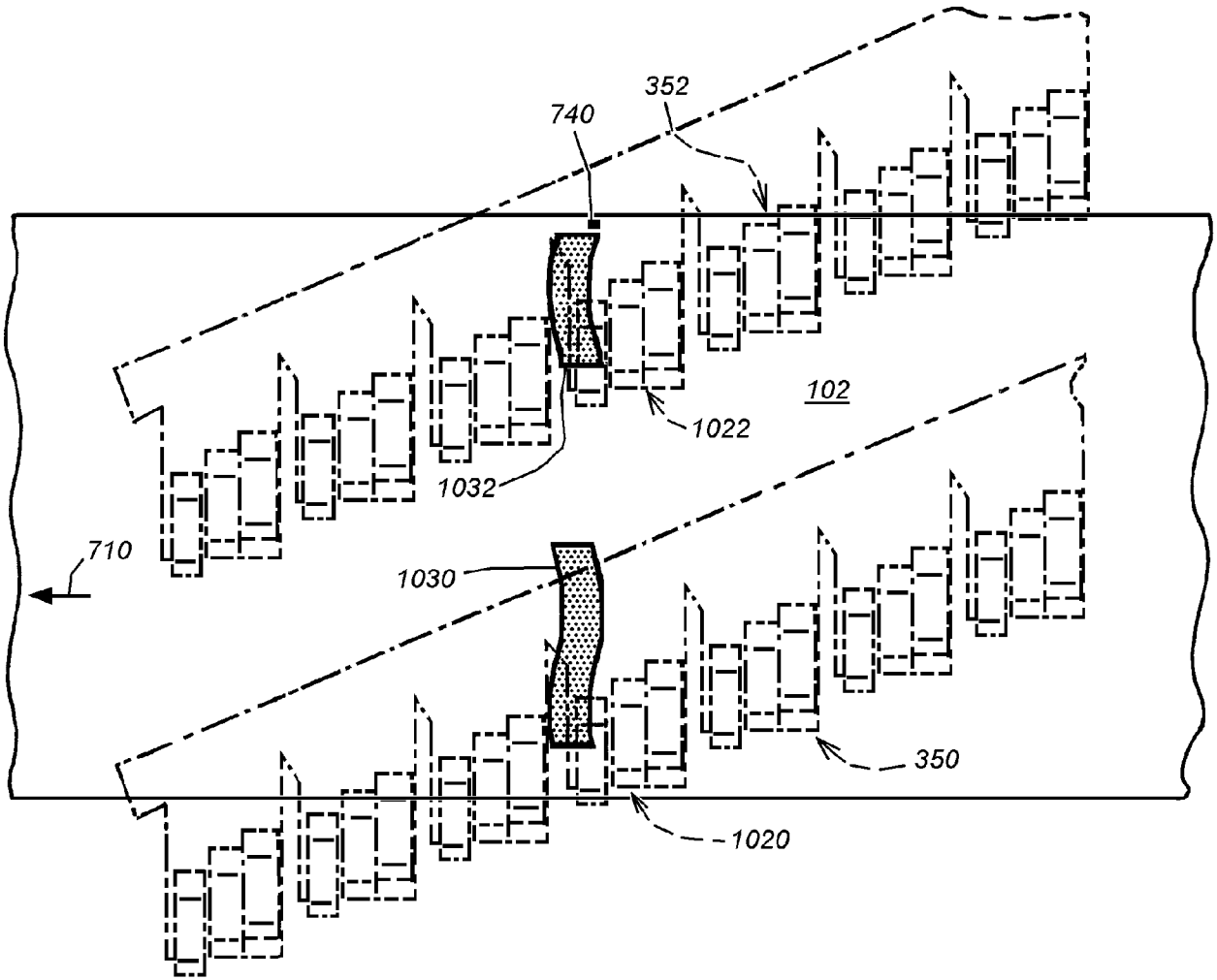
FIG. 10 is an exposed top view of a print run in process detailing the creation of fourth printed increment of the exemplary printed feature on a continuous web.
Figure 11:
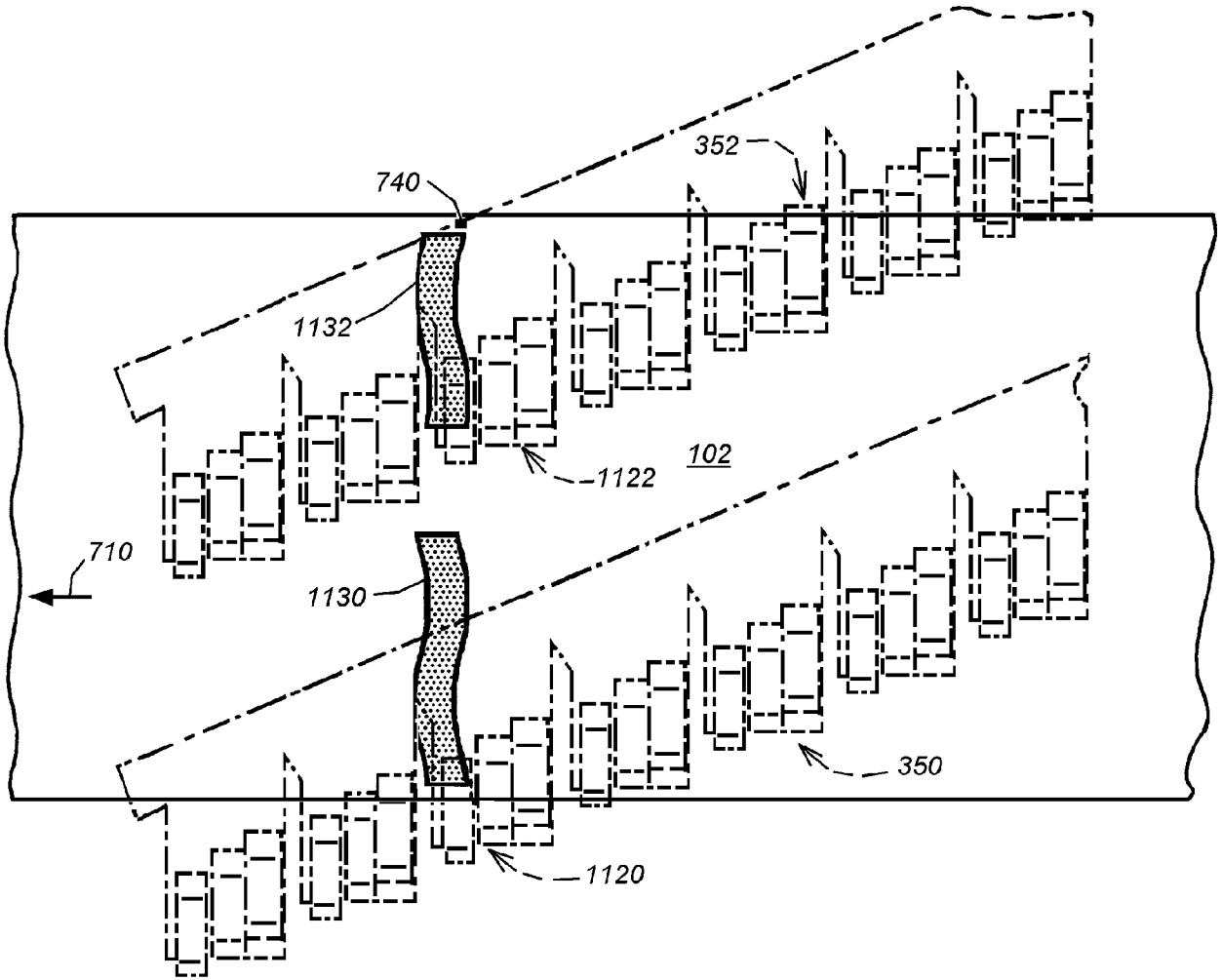
FIG. 11 is an exposed top view of a print run in process detailing the creation of fifth printed increment of the exemplary printed feature on a continuous web.
Figure 12:
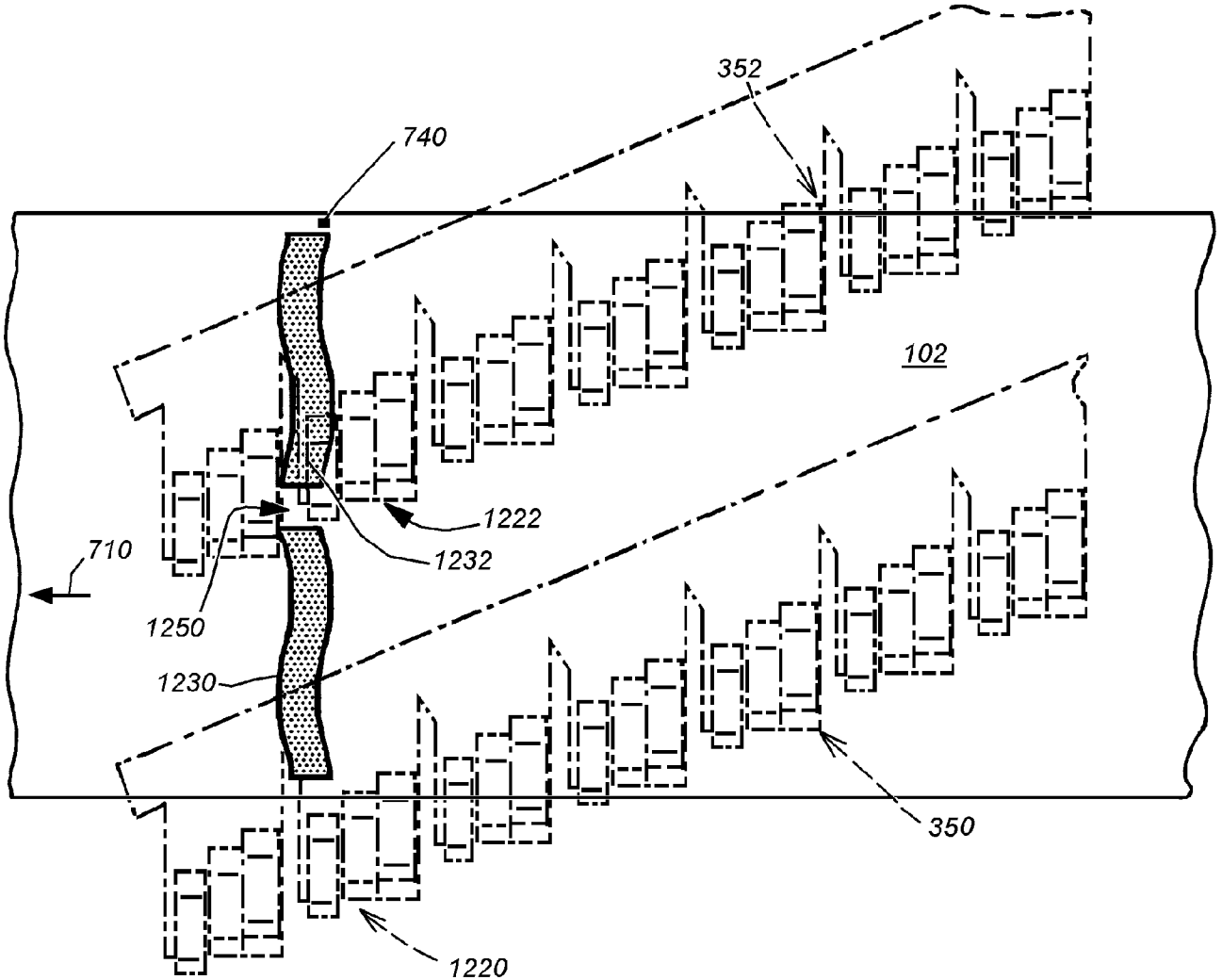
FIG. 12 is an exposed top view of a print run in process detailing the creation of sixth printed increment of the exemplary printed feature on a continuous web.

In FIG. 10, the web 102 has moved further downstream and the segments 1030 and 1032 have grown based upon the sequenced firing of imagers 1020 and 1022, respectively. In FIG. 11, the imagers 1120, 1122 have fired to further build the segments 1130, 1132. In FIG. 12, the imagers 1220 and 1222 nearly complete the segments 1230, 1232, with only a small central gap 1250 remaining.

Figure 13:
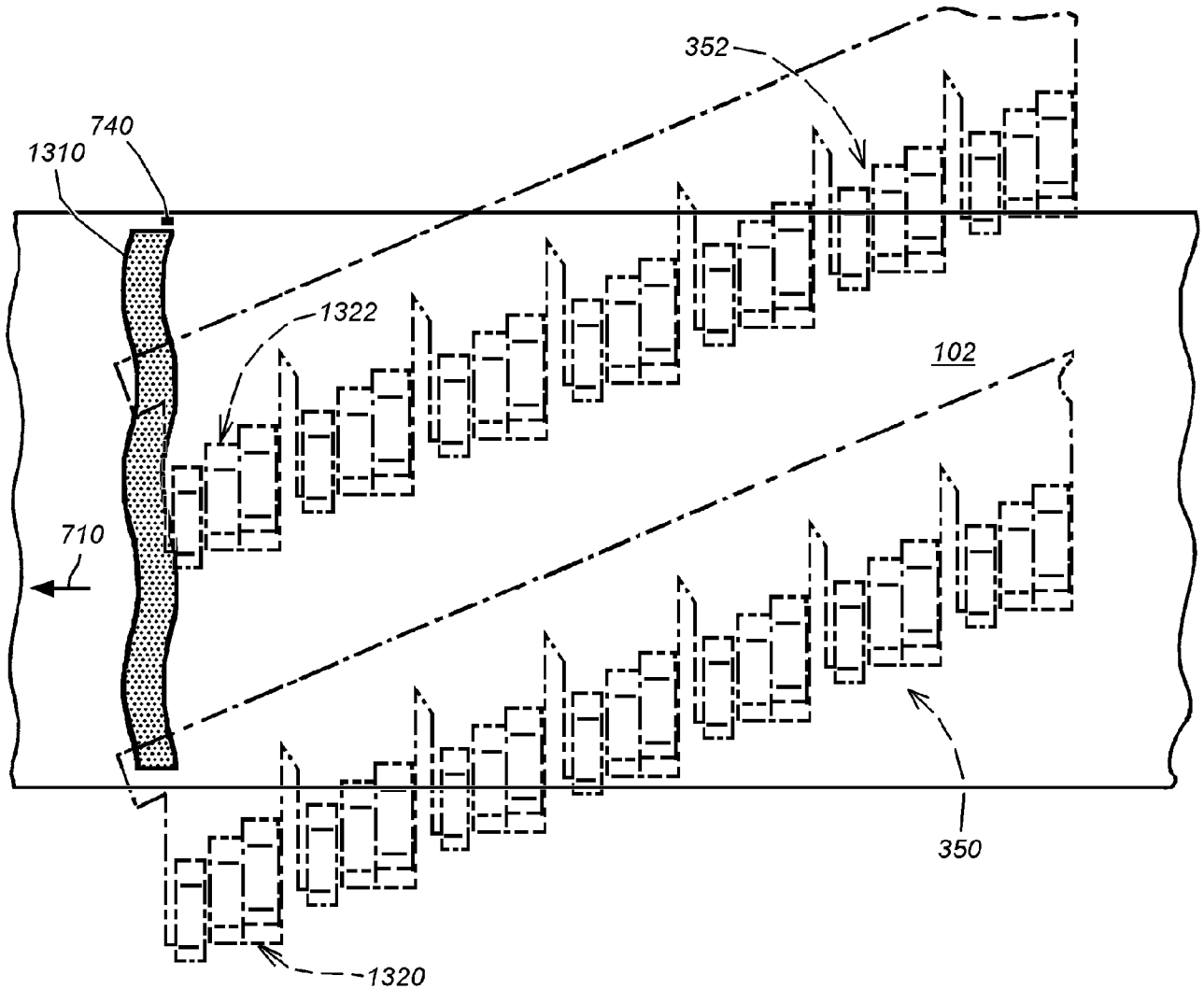
FIG. 13 is an exposed top view of a print run in process detailing the creation of final, seventh printed increment of the exemplary printed feature on a continuous web.

Finally, in FIG. 13, the overall image 1310 is completed with the firing of the downstream-most imager 1322 of the assembly 352. The opposing parallel imager 1320 in assembly 350 does not fire since it is located beyond the edge 952 of the web 102. For wider webs, all imagers may, in fact, fire at various times. In addition, it should be clear that the various imagers/print heads of the array may be firing simultaneously to generate images that are closely spaced (or continuous) in the feed (upstream-to-downstream) direction of the web.

Figure 14:
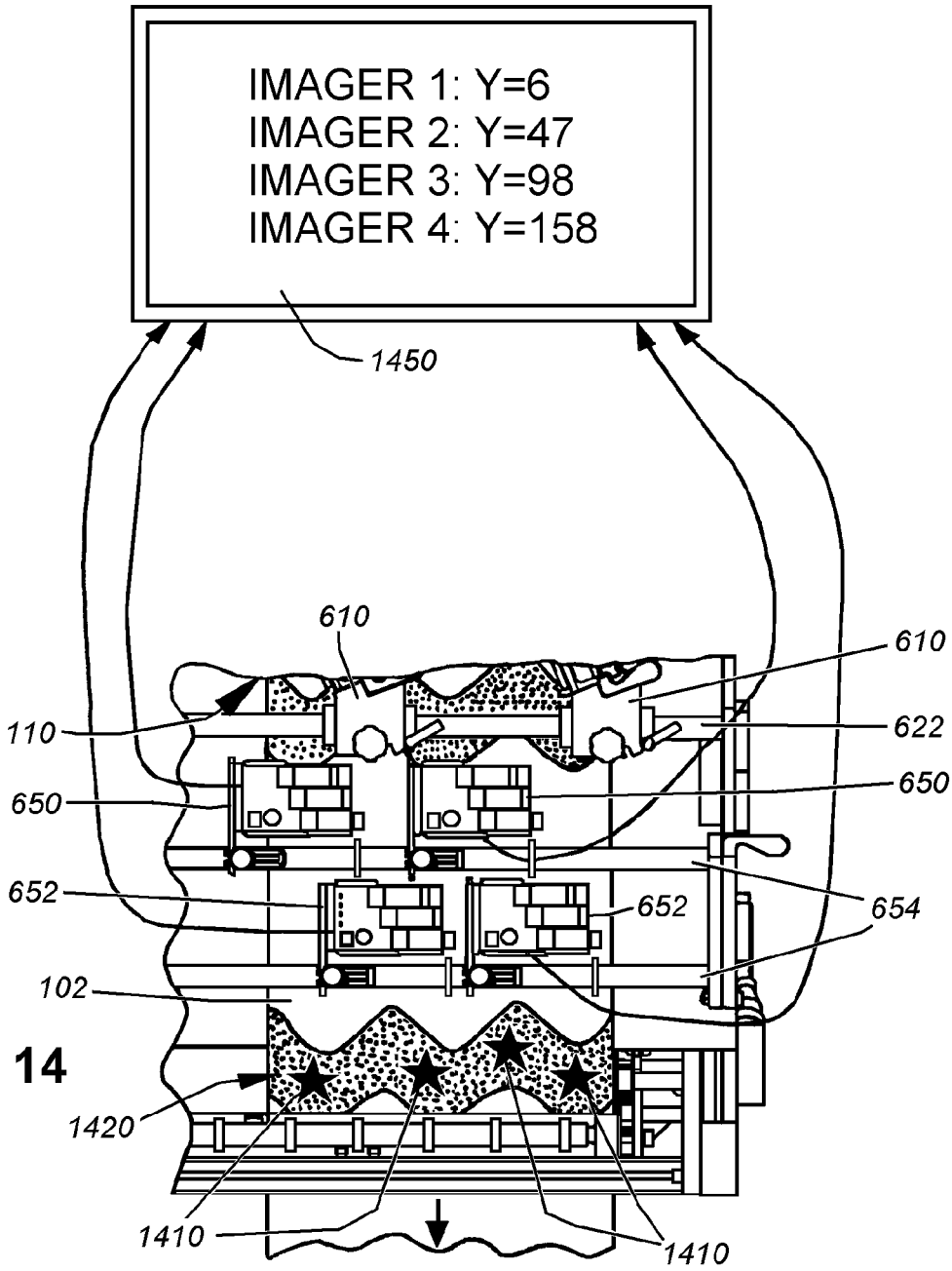
FIG. 14 is a fragmentary top view of a plurality of spot-printing ink-jet pen assemblies and associated position indicators detailing the printing of exemplary spot features on the web.

As described above, each side of the web can also be printed upon using one or more spot-printing imagers 650, 652. In FIG. 14, the imagers 650, 652 are shown having applied respective spot images 1410 (stars) to an overall image pattern 1420 that has been applied to the web 102 via the upstream array 110. As noted the spot imagers can be located at any point along the overall feed path so long as there is ample ink-drying time provided before the printed surface is contacted by a component of the device. In this embodiment, the position of each spot-printing imager 650, 652 is tracked and indicated on a display screen 1450. The imagers communicate with the screen 1450 via the device's logic or another circuit that translates a location of each imager 650, 652 on its respective track. The information on widthwise location can be derived using encoders, or other devices known to those of ordinary skill, provided at the sliding interface between the rails 654 and the imagers 650, 652. For example the rails can be provided with a rack gear (not shown) and the imager slide bases can be provided with encoders having intermeshing gears. In alternate embodiment, the adjustment of the spot-printing imagers along the rails 654 can be accomplished using stepper motors or servos that drive the individual imagers along a rack and provide position feedback to the display 1450. The display can include an appropriate user interface to allow the widthwise position of each imager to be set.

Figure 15:
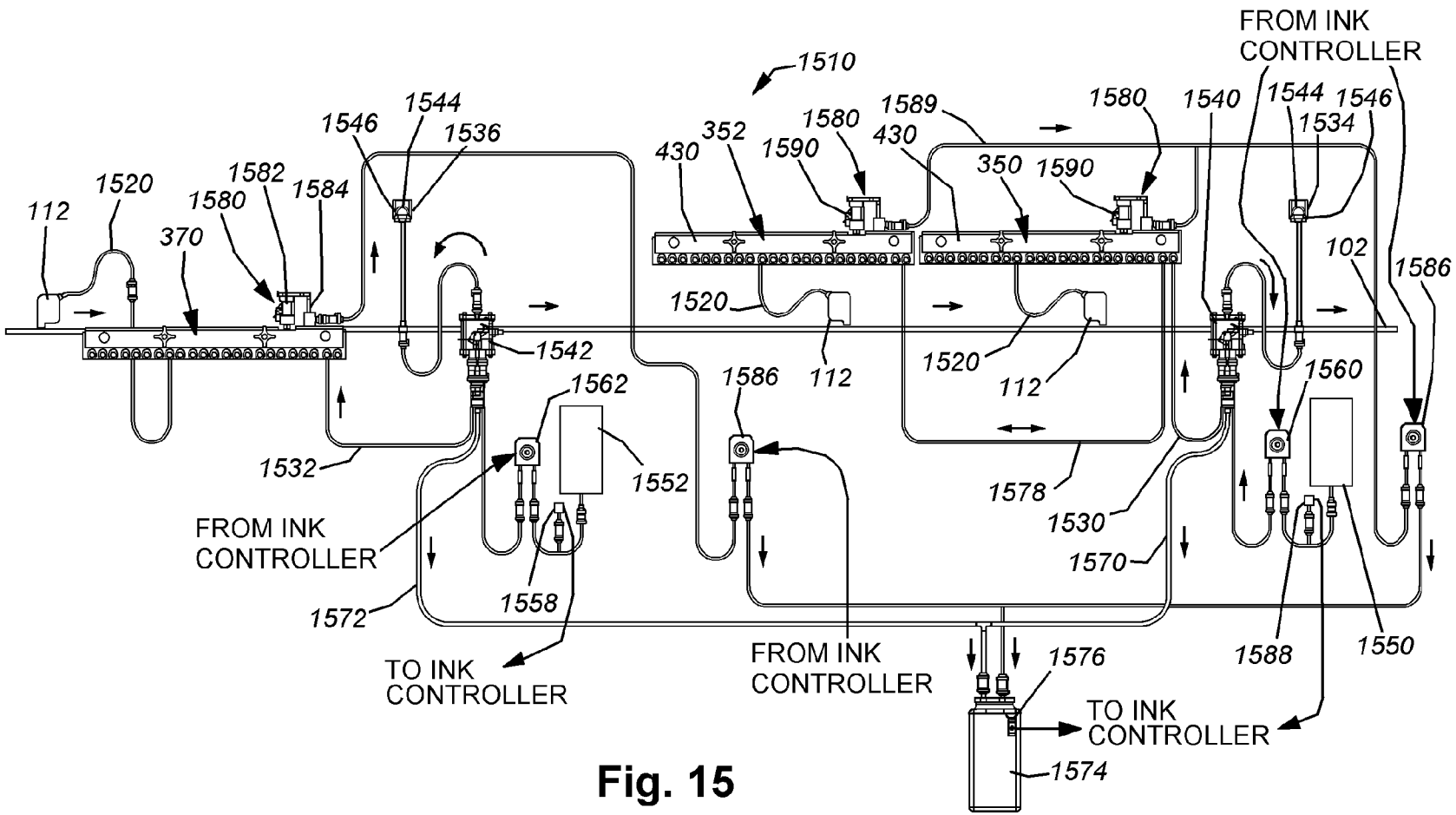
FIG. 15 is a diagram of the various ink-feed components employed to deliver ink to the manifold assemblies of the system of FIG. 1.

Reference is now made to FIG. 15, which further details the system 1510 for feeding bulk ink to the device's manifolds using the upper level as the example. The lower level is similarly served by a separate ink-feed system that is substantially the same. In general the pens 112 must maintain an air-free environment within their housings. Since the print heads are directed downwardly, the cartridges rely upon a carefully maintained vacuum to retain the ink within the head until it is ejected by the nozzle using thermal, piezoelectric effects (or another mechanism). Failure to maintain such a vacuum causes ink to seep from the print head, which degrades or destroys print quality. In a standalone, sealed cartridge, without the illustrative feed tube, an internal spring is used to maintain a vacuum of appropriate magnitude. In essence the spring draws a plunger against a bladder within the small ink-storage tank of the housing to maintain the vacuum and prevent seepage.

However, where a continuous feed of ink is provided via the tubes 1520 and interconnected manifolds 430 and 370 (and 380 above), the spring and plunger arrangement are bypassed and a more-comprehensive approach to maintaining a vacuum is desirable. This approach enables the specified hydrostatic pressure of approximately −1.5+/−0.2 in of water to be maintained at the print nozzles.

As shown in FIG. 15, each depicted manifold 430 (fixed array), 370 (movable array) is interconnected by a respective feed line 1530, 1532, which receives bulk ink under vacuum draw from the interconnected manifold via a respective regulator tank 1540, 1542. The dual manifolds 430 controlled by the regulator tank 1540 each feed a respective, fixed, 21-pen array. The operative principles to be described below also apply to the fixed array manifold 370 and its interconnected regulator tank 1542 which controls ink-feeding to the movable, 12-pen, spot pointing array. The parameters described herein are particularly directed toward the illustrative arrays and their associated number of pens. Where the number of pens varies from that shown herein, the applicable ink-feed rate, pressure tank size and other parameters may be varied accordingly.

In summary, each array manifold 430 (fixed), 370 (movable) is fed by its own bulk ink supply 1550, 1552, respectively. Each connection contains a respective feed line 1530, 1532 from the regulator tank 1540, 1542. Excess ink from each tank 1540, 1542 is directed through a raised inlet (1618 in FIG. 16) along a respective line 1570, 1572 to a common waste tank 1574. Ink from each supply 1550, 1552 is biased into the respective regulator tank 1540, 1542 by a respective pump 1560, 1562. Note that in an illustrative embodiment, the ink pumps are peristaltic, as this pump design typically allows for easy removal of the wetted element of the pump during an ink color change. Pumps having a feed rate of at least 16 ml/minute should be sufficient to provide sufficient ink to the pens at a maximum usage rate.

Having described the constituent components for both the fixed array ink-feed circuit and the movable array ink-feed circuit, the following discussion will focus upon the fixed array circuit components. The description is the same for like components in the movable array circuit and for the circuits employed on the lower level.

Figure 16:
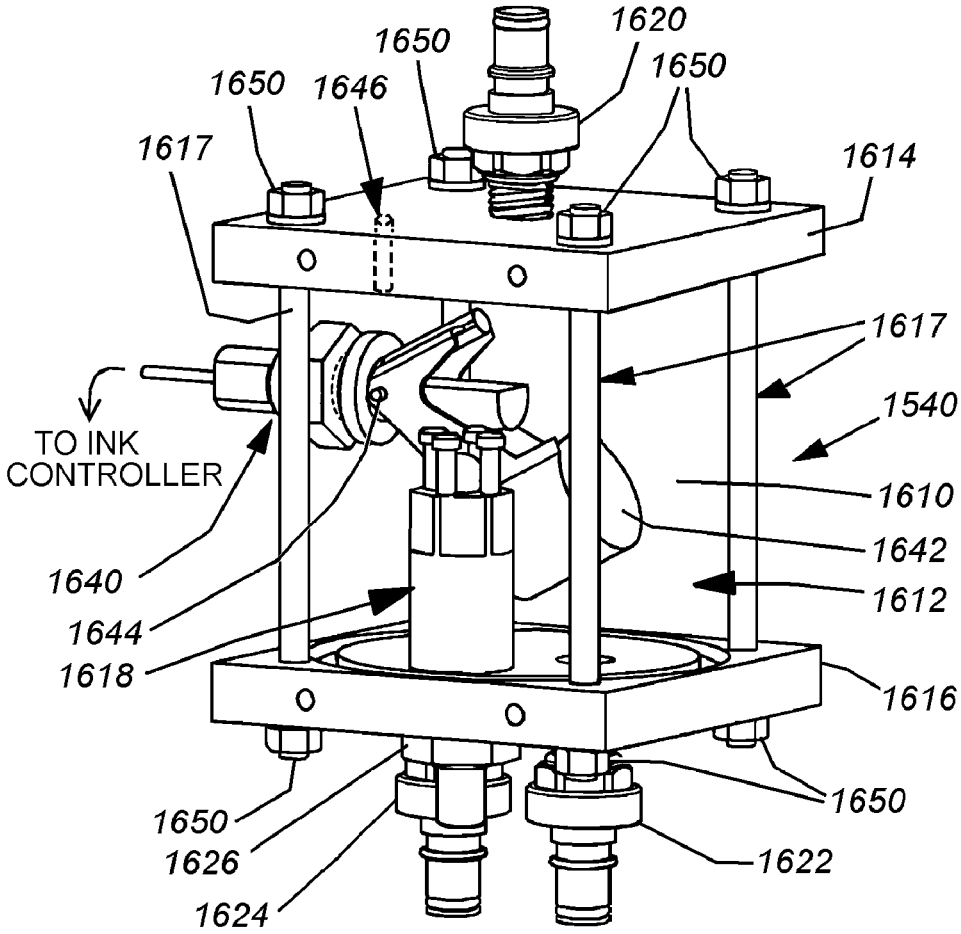
FIG. 16 is a more detailed perspective view of a pressure regulator tank for use in feeding ink to a manifold.

The exemplary regulator tank 1540 is shown in further detail in FIG. 16 by way of example of all regulator tanks used herein. The tank includes a sealed chamber 1610 defined by a cylindrical wall 1612 (transparent for viewing and diagnosing problems in this example) that is secured between opposing base plates 1614 and 1616. The plates 1614, 1616 are compressed against the cylinder 1612 by four threaded rod assemblies 1617. Appropriate gaskets or seals can be used to create a liquid-tight seal between the regulator components. A series of quick-disconnect connectors, each in fluid communication with the chamber, are provided to the top plate 1614 and the bottom plate 1616, which are described further below. The regulator tank 1540 provides for a supply of ink from the connected bulk ink bag 1550 in the presence of a mostly-contained volume of air, maintained at atmospheric pressure. The atmospheric pressure reference is needed to establish the pressure head reference for the ink pens that it supplies. In the illustrative embodiment and as described above, the output jets of all connected pens are maintained at a pressure head of −1.5+/−0.20 inches of water, relative to the ink level in the tank 1540. The overall machine negative pressure level is maintained at 1/16 inch of water per foot of table height to ensure that pressure head accuracy between the pens and their associated regulator tank is preserved. This back-pressure is maintained at all times to prevent the pen from leaking ink through capillary action, to the surroundings. In this manner, the vacuum level is just sufficient so that ink sprayed from the nozzles is replaced as the cartridges effectively draw new link from the connected manifolds.

The ink level in the regulator tank 1540 is maintained over a range of +/−0.20 inch of vertical distance (24.23 milliliters volume) by means of the cycling of the peristaltic ink feed pump 1560, whose operation is triggered by a float switch positioned in the tank. The float 1642 rises and falls on a pivot 1644 in response to the level on ink in the tank 1540. As the level falls, the feed pump 1560 is triggered on, and as the level rises the pump is cycled off. This feed pump cycle provides 50 ml of ink at a rate of 130 ml/min, requiring about 22 seconds. The hysteresis that is a characteristic of the float switch, provides for a convenient mechanism to obtain a finite high/low ink level within the tank using only one sensing device. Although other sensor types could be employed, the float switch provides advantages of low cost and insensitivity to the rough handling that may occur during transport of the ink system to and from the machine during a color change.

Figure 17:
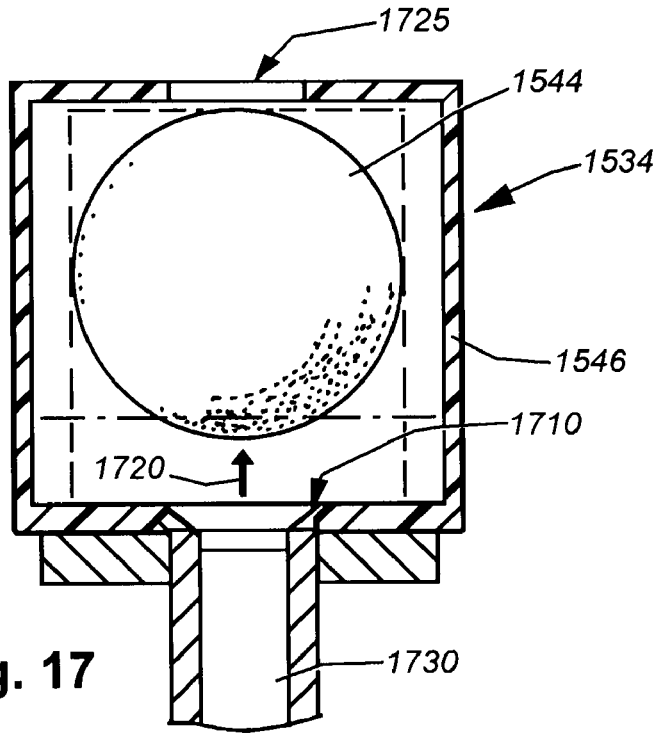
FIGS. 17 and 17A are each exposed side views of an exemplary low-pressure relief valve in a sealed and opened state, respectively in accordance with an embodiment of this invention.
Figure 17A:
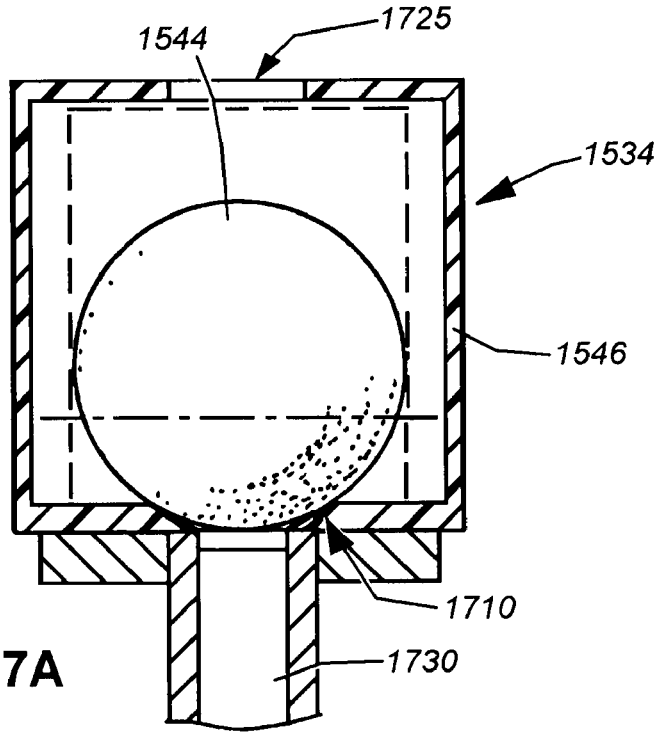

It is noted that the present specification for ink states that it should not come into contact with unsaturated air so that evaporation of the water component is prevented. The illustrative embodiment serves to substantially contain the 280-milliliter volume of air that is in contact with the ink within the regulator tank 1540, by severely restricting interaction between the air in the tank 1540 and external air. This is accomplished by providing a pin hole entrance (1646 for example) for air into the tank 1540, that is needed to fill the volume vacated by the drawing of ink out of the tank by the pens during operation at a typical rate of 5 ml/minute. Expulsion of air from the tank caused by the peristaltic ink feed pump cycling ink into the tank (50 ml at 130 ml/min, over 22 seconds), is provided for by a very low pressure check valve (0.025 psi cracking pressure) that blocks air transfer to the environment during all but the fill cycle. Thus, each regulator tank 1540, 1542 is interconnected with an air-relief valve 1534, 1536 that exhausts excessive pressure buildup. In an example that is shown in detail in FIGS. 17 and 17A, the valve (1534 is shown) bleeds excess pressure via a lightweight ball cover 1544 that seals against the chamfered seat 1710 a ball-containing cup 1546. The valve operates a significantly low-level of cracking pressure—approximately 0.025 psi differential pressure. The ball 1544 normally seals the passage (FIG. 17), but can pop up (arrow 1720 in FIG. 17A) to bleed excess pressure to the atmosphere (through a top outlet 1725 via the bottom connecting tube 1730) as needed. In one embodiment, a ping-pong-style ball can be included. The seal is imperfect so that positive external pressure can also gradually pass through the ball 1544 and seat 1710 to equalize pressures. The size and shape of the low-pressure bleed valve is highly variable. The degree of separation between the air in the tank 1540 and the environment, will create a stable environment for the gas in the tank which will minimize the evaporation/condensation cycle of the water component of the ink within the tank. The regulator tank is designed to be disassembled easily by unscrewing nuts 1650 on the ends on the threaded rods 1617, so that any solids that may accumulate over time as a result of evaporation and expulsion of the water component of ink, can be removed during a normal maintenance of the system.

The pressure regulation tank provides for a "feed pump stuck on" failure with an internal overflow standpipe 1582 which drains to the waste holding tank 1574 located in the bottom section of the printer. The opening of this standpipe is covered by a light plastic, buoyant check ball (not shown) such that it remains sealed from the environment during normal operation. To ensure that a vacuum is maintained, each manifold 430, 370 includes a vacuum sustaining interconnect 1580 along its top end. The standpipe provides a convenient location for the ink level maintenance sensor 1590 (which is a capacitive type sensor in this embodiment. The standpipe's large cross-sectional area (approximately ¾ inch internal diameter) provides for the separation of all air bubbles that might otherwise allow "slugs" of air-mixed-with-ink to return to the vacuum sustain maintenance pump 1586. A common vacuum sustain line 1589 between both manifolds in the array 430 ensures that their levels are maintained in parallel. Any excess ink/air is drawn through a respective pump 1586. From each pump 1586 the excess is driven into the waste tank 1574.

For the array manifolds 430, an equalization line 1578 allows maintenance of an equal pressure between the "master" manifold (for pen assembly 350), which is connected to the regulator tank 1540 and the remote, "slave" manifold (for pen assembly 352). The connection is relatively short (as are others herein) and the ink flow rate is low enough (5 ml/min) so as to provide a low-impedance flow characteristic. Like all other ink-feed/pressure lines shown and described herein this line 1578 is interconnected using dripless quick-disconnect couplers that enable rapid changeout for replacement, cleaning, color change, and the like.

The above-described system, thus maintains the needed vacuum at the manifolds so as to prevent seepage of ink from nozzles, and ensures desired delivery of ink to the manifolds as it is drawn from the nozzles. Each regulator, in particular is adjusted to provide the needed pressure for ink delivery, while the appropriate level of vacuum draw prevents introduction of air to the system.

Figure 18:
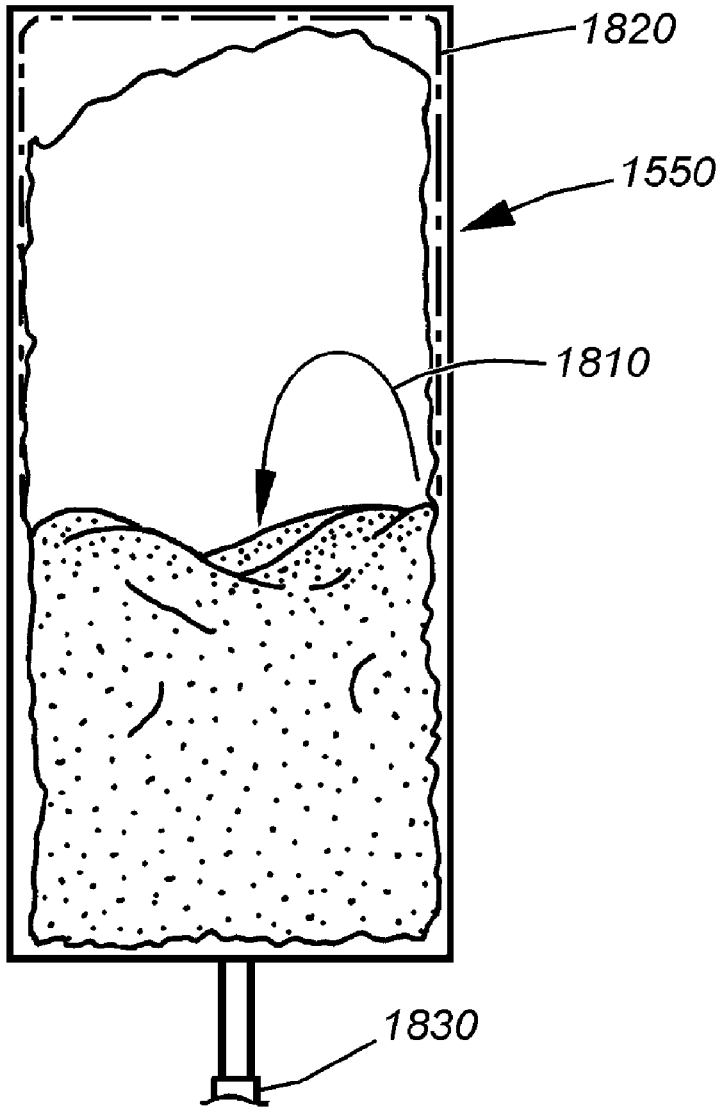
FIG. 18 is an exposed front view of an exemplary bulk-ink container and bag in accordance with an illustrative embodiment of this invention.

Each regulator tank 1540, 1542 also communicates with a respective bulk-ink supply 1550, 1552. In this embodiment, the supply is a sealed bag within (for example) a cardboard box enclosure. A cut-away example of a bulk ink container 1550 is shown in FIG. 18. The ink-containing bag 1810, within the cardboard box 1820 loses volume (as depicted) as it is drained. The bag is sealed except for the outlet connector 1830 with no separate air vent. This ensures high efficiency in ink consumption and maintains the overall vacuum (up to approximately −7 psi versus atmospheric) needed by the feed system 1510. In fact, the vacuum ensures that bags are emptied virtually completely eliminating waste of costly ink. Each bag typically contains 800 milliliters of ink of a desired color. The colors chosen are highly variable and the user is not limited to any preloaded color as in the case of a standalone print cartridge. Note that each manifold is connected with at least one bulk ink supply. Thus the lower fixed and movable arrays are served by a separate ink-feed system similar or identical to that shown (1510) in FIG. 15.

Inline with each bulk supply is a bag-empty detect sensor 1558, which senses the presence of flowing ink in a given quantity. If ink is not sensed, then the sensor informs the device controller, which signals an alarm and/or stops printing. From the sensor 1558, each ink supply 1550, 1552 is fed through the respective ink-feed pump 1660, 1662. The pump can comprise a peristaltic or equivalent pump that efficiently delivers a consistent, low-volume flow to the respective regulator tank 1540, 1542. The regulator tanks 1540 and 1542 each include an accidental discharge line 1570, 1572 that feed to the overflow/waste tank 1574. The waste tank 1574 must be emptied occasionally. It includes an overflow/full-condition sensor 1576 that communicates with the controller, and instructs an alarm/stop condition when triggered.

Figure 19:
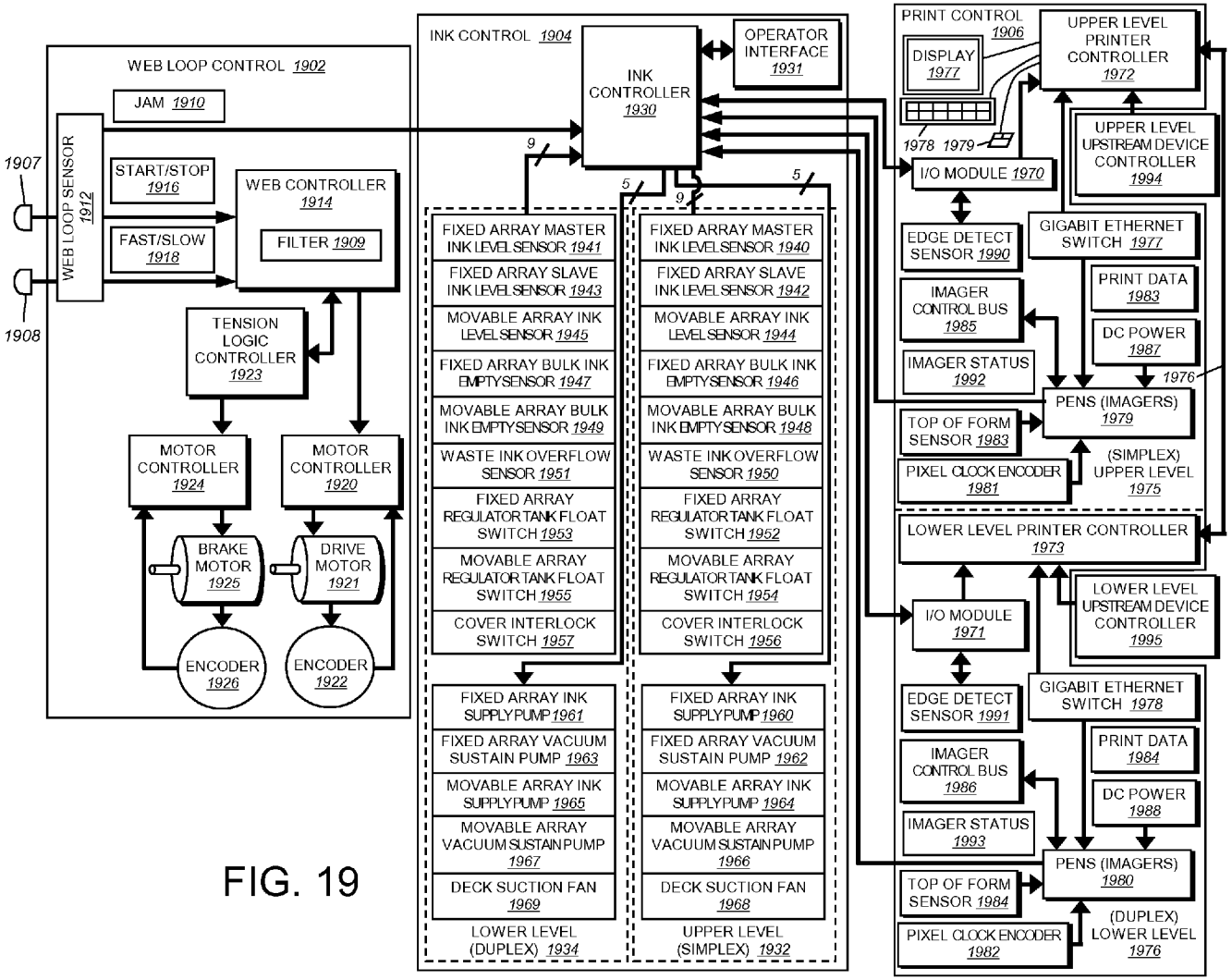
FIG. 19 is a block diagram showing various control components in connection with the device in accordance with an illustrative embodiment.

FIG. 19 details the control system 1900 for the printer in accordance with an illustrative embodiment of this invention. The system is divided into at least three controls, namely the web loop feed control 1902, the ink-feed system control 1904 and the print/imager control 1906. The web loop control 1902 directs the web at a predetermined speed through the device in accordance with the above-described Z-shaped path. The feed control is generally separate from other controls herein except for the sharing of a jam signal 1910 that issues from the web loop sensor 1912, in the event of a failure to feed web from the upstream source. Two discrete sensors of this element monitor the web loop at the input of the printer. When web loop in front of the top sensor (start/stop sensor) 1907, which causes a start/stop signal to be sent to the web controller 1904. The web controller in turn sends a 0-10 volt DC signal to the input of a conventional motor controller 1920. The motor controller sends direct current (0-90 VDC) to the down-stream-mounted main drive motor 1921, causing it to drive that web. This speed is regulated by an in internal or external encoder or tachometer 1922 that provides feedback to the motor controller 1920.

The web loop controller 1914 also communicates with a tension logic controller 1923 that ensures a predetermined level of tension is maintained in the web. In general, the braking torque is provided by an upstream braking torque motor 1925 with another conventional motor controller 1924 interconnected with the tension controller 1923. The braking torque motor controller 1924 is adjusted to cause this torque motor 1925 to run slightly slower than the main drive motor 1921, thereby generating a torque-induced tension in the web path. The operation of the brake motor 1925 is regulated via an internal or external encoder/tachometer 1926 that feeds back movement information to the motor controller 1924.

Because the printer is taking up web at a slower rate than the upstream web source (a driven roll stand or another printer, for example) is delivering it, the loop continues to fall until it moves in front of the second, lower sensor (fast/slow sensor) 1908. This sensor 1908, when activated by the presence of the web loop in its field of view, sends a signal to the web controller 1914, causing it to increase the input of the main drive motor controller 1920, which in turn drives the main drive motor 1921 faster. The main drive motor 1921 then is able to run at a set point set slightly faster than the up-stream device and the printer is therefore able to keep pace with the upstream web source device. The tension logic controller 1923 provides an appropriate speed change to the braking torque motor controller 1924 to correspondingly vary the speed of the braking torque motor 1925 so that the proper level of torque-induced tension is maintained.

A filtering circuit 1909 within the web controller 1914 is used to smooth out the "hunting" of the web loop as it cycles between the two speeds that bracket the speed of the upstream source device.

In an illustrative embodiment, the throughput web speed of the printer can be increased where a lower resolution of print (measured in dpi), particularly in the feed direction, is permitted. For example, where the resolution is maximized at 600×600 dpi, the maximum feed speed is approximately 25 inches per second (125 feet per minute (fpm) or 0.635 m/s). Where the resolution is 600×300 dpi, the feed speed is approximately 50 inches per second (250 fpm or 1.27 m/s). Where the resolution is 600×150 dpi, the feed rate may be as high as 100 inches per second (500 fpm or 2.54 m/s). These values can be varied where the performance characteristics of the pens and their nozzle size differs from those described herein.

The jam signal 1910 from the web loop control 1902 is carried to the ink controller 1930, which operates the ink control system 1904. The jam signal instructs the ink control system to cease feeding ink. In normal, unjammed operation, the system feeds ink at a predetermined rate, as described above. The ink controller can be a microprocessor, or, in an illustrative embodiment, a programmable logic array (PLA) that contains a predetermined instruction set so as to respond to the inputs and outputs described below. The controller can be programmed, monitored and provided with control information via an operator interface 1931. Since ink control is provided separately to the upper and lower sections of the printer, these functions are divided into an upper section box 1932 and a lower section box 1934 as shown. When both the upper and lower sections 1932, 1934 are operated, the printer is running in two-sided or duplex-print mode. When only the upper section 1932 is operating, the printer runs in single-sided or simplex-print mode. Note that simplex-print mode can also be implemented on only the lower section 1934, with the upper section 1932 not operating. For the purposes of this description, simplex is taken to apply to the upper section.

The ink controller 1930 receives nine independent inputs from nine corresponding sensors in each section. As stated above each section contains its own version of all the same feed system components. Hence the controller receives input signals from the following inputs on the upper section and a lower section: (a) a fixed array master ink level sensor signal 1940, 1941 from a sensor attached to each fixed array master manifold that ensures an adequate level of ink is received in each master manifold; (b) a fixed array slave ink level signal 1942, 1943 from a sensor attached to each slave manifold, which is connected to the master manifold (via connection 1578, for example); (c) a movable array ink level sensor signal 1944, 1945, which ensures the manifold (370, for example) for each movable array is sufficiently full; (d) a fixed array bulk ink sensor signal 1946, 1947 (see sensor 1558, for example), which ensures a sufficient level of bulk ink is still available in each ink container; (e) a movable array bulk ink sensor signal 1948, 1949; (f) a waste tank overflow sensor signal 1950, 1951 (for example sensor 1576), which detects a near-overflow in the waste tank requiring it to be emptied; (g) a fixed array regulator tank float switch signal 1952, 1953 (for example, switch 1640) that detects the proper level of ink in each fixed array regulator tank; (h) a movable array regulator tank float switch signal 1954, 1955; and (i) a cover interlock switch signal 1956, 1957, which ensures covers are closed and arrays are properly positioned before a print operation can occur. Based upon the input signals provided by the various sensors/input devices, the ink controller 1930 regulates ink feed and, when necessary, shuts down operation and/or issues an alarm. For example, a waste-tank-overflow condition causes a DEVICE NOT READY signal to be sent to the upstream device and posts an alarm message on the operator display. Activation of one of the bulk ink empty sensors causes the feed pump to immediately turn off and a message to be sent to the operator display. The ink controller 1930 provides output control signals to the following components on each of the upper level 1932 and lower level 1934: (a) a fixed array ink supply pump control signal 1960, 1961 (for example, pump 1560); (b) a fixed array vacuum sustain pump control signal 1962, 1963 (for example, pumps 1586); (c) a movable array ink supply pump control signal 1964, 1965 (for example, pump 1562); (d) a movable array vacuum sustain pump control signal 1966, 1967 (for example, pumps 1586); and (e) a deck suction fan control signal 1968, 1969 (e.g. the fans that create a suction in the feed surface vacuum boxes). Power is directed to the vacuum box fans on both the upper and lower surfaces when the controller 1930 receives a cycle up signal from the upstream device or the operator.

These control signals regulate the connected pumps and components to provide ink in accordance with the above-described parameters and to cut off the ink supply in event of an alarm condition or stop command. One particular alarm/stop feature is the watchdog time function built into the ink controller 1930 that monitors the run duration of the vacuum sustain pump cycle and shuts it off if it runs beyond a settable time limit. This action is relayed to the print controller 1972 and used to alert the operator to a possible failure.

The ink controller 1930 is monitored and controlled by the print control system 1906. Data is passed between the ink controller 1930 and the print control system 1906 via a pair of input/output (I/O) interface modules 1970 that communicate with respective upper and lower level printer controllers 1972, 1973. For the purposes of this description, the printer controllers 1972 and 1973 have been divided into functional blocks that respectively serve to control upper level printing (1974) and lower level printing (1975). In this depicted organization, an Ethernet or bus link 1976 is shown between the upper level printer controller 1972 and the lower level printer controller 1973. In some embodiments, the link can be a logical connection, and these controllers 1972 and 1973 can reside within the same processor and/or computer. In this embodiment, the computer is a personal computer (PC) running any acceptable operating system and printing application(s). A graphical user interface is provided on a display monitor 1977. The printing and printer control functions can be selectively displayed and controlled via the interface using an attached keyboard 1978, mouse and/or another interface device (such as a conventional touchscreen). Typically, only one computer of the pair (1972, 1973) would link to the user interface, which allows control and monitoring of both computers and their processes. In this embodiment, the interfaced print controller's (1972) internal software provides the operator with the menu-driven graphical user interface to set up and control the printer system during normal operation. Also, password protected maintenance operation menus can be provided for servicing and diagnostics.

An Ethernet switch 1977, 1978 connected to the gigabit (base 1000T) Ethernet port of each controller computer 1972, 1973 provides print data 1983, 1984 in an appropriate format to all the imagers 1979, 1980, of each level, respectively. The data required by each imager, other than the pixel clock and top of form signals, is provided through a dedicated Ethernet port of the respective switch 1977, 1978. Print job information including the bitmap data, is transferred to each imager through the computer controller via an Ethernet connection to the imager. Each imager receives a discrete input from a port of the switch and is appropriately addressed by the imager's controlling software on the controller computer 1972, 1973.

The upper and lower levels are independent and have their own paper movement encoder (pixel clock) 1981, 1982, respectively, and top of form sensor 1983, 1984. In some cases, an optical symbol reader for page identification is provided and/or mark sensor for registration control (for what is to be printed relative to what is already present on the web) and information triggering).

One imager on each deck receives the pixel clock and top of form signals from the encoder and sensor, respectively. These signals are then daisy-chained to the remaining imagers using a circuit board that allows them to be interconnected. A respective imager control bus 1985, 1986 interconnects each of the imagers on each level. Image synchronization with the moving web is accomplished by the software using signals from the respective encoder and predetermined imager position information which is established during system setup. DC power 1987, 1988 required to operate each imager is also chained to each imager in each level.

The system also employs edge detectors 1990, 1991 that sense the widthwise side edges of the web and are used to determine the printing width of the web and location of the edges. This information is passed through each respective I/O module 1970, 1971 back to the respective controller computer 1972, 1973. The imagers 1979, 1980 on each level also pass respective status information 1992, 1993 back to the ink controller 1930 (and also as back to the controller computer 1972, 1973). This status information can be used to trigger a rapid shut down of the ink-feed system if a cartridge has failed.

Each printer controller 1972, 1973 also respectively receives print information and other instructions from an upstream printer or other web utilization device 1994, 1995. The information may be print data, tracking information or other data needed to undertake the print function.

It should be clear that the above-described organization of controllers and the division of responsibilities can be varied in alternate embodiments. Likewise, responsibilities provided to the various controllers can be consolidated into a single controller in alternate embodiments, or distributed among a larger set of localized controllers.

It should also be clear from the foregoing description that a number of significant advantages are provided by the printer of this invention. In accordance with the above described system, all pens can be replaced without the need to "re-stitch" the printing, and because pen life depends on the distribution of use of the individual jets. Moreover, bulk ink supply containers can typically be replaced without stopping the printer due to the system's resident supply of useable ink between the bulk supply and the pens. In addition, the above-described system addresses a key requirement in implementing pen arrays as large as described, namely the need to manage the vast amount of electrical wiring and fluid tubing in a very limited amount of space. To that end, the ink manifold system of this invention is deployed in close proximity to the location of the pens that it supplies. Likewise, two specially-designed printed circuit boards are employed, mounted close to the imagers to allow for manageable transfer of power and control signals. Another notable feature of the ink bulk feeding system is that it allows for quick initial filling of the system with ink. This addresses a disadvantage that has plagued the existing state of the art systems that utilize dedicated, or small manifolded, pens fed by a sealed fluid regulator of the type offered by manufacturer Hewlett Packard. With conventional technology, much time is required to prime the system and remove all of the air from the ink carrying components. The system of this invention provides a reference to atmospheric pressure created within the regulator tank, allowing ink to be drawn into the manifold with the vacuum sustain pump as it removes excess air from the components through this same action. These, and other advantages discussed herein, provide for a highly effective and usable printing system.

The foregoing has been a detailed description of illustrative embodiments of the invention. Various modifications and additions can be made without departing from the spirit and scope thereof. For example the teachings described herein can be applied to a variety of arrangements of ink jet pens, both in a duplex and a single-sided mode. The arrangement of manifolds and the interconnections thereto can be widely varied. In addition, any function described herein can be implemented using electronic hardware components, software, including program instructions executing on a computer processor or a combination of hardware and software. Furthermore, while the printer of this embodiment can print in any color or group of colors desired, it is expressly contemplated that any or all bulk ink supplies described herein can be filled with a basic black ink for straightforward black-and-white (or grayscale) printing. As used herein the term "color" should be taken to include black. Also, it is expressly contemplated that some or all of the pens mounted in the printer can be conventional sealed, non-bulk-supplied pens. For example, where a quick color change is needed on a small job, changing out the ink system may be inefficient, and mounting of sealed pens in selected arrays may be appropriate. Accordingly, this description is meant to be taken only by way of example and not to otherwise limit the scope of the invention.

What is claimed is:

1. A system for printing a continuous web using ink jet pens that are fed from a bulk ink source, the system comprising:

a web drive that directs the web in a downstream direction along a feed path;

a first array of ink jet pens fed from the bulk ink source that are located on the feed path to print along a first side of the web, the pens being arranged as a first pen assembly and a second pen assembly so as to lay down ink along a first diagonal line with respect to the feed path so that an upstream-most cartridge of the first pen assembly includes a nozzle that overlaps a nozzle of a downstream-most cartridge of the second pen assembly to span across the web, wherein the width of the web is at least 17 inches;

a second array of ink jet pens fed from the bulk ink source that are located on the feed path to print along a second side of the web, the pens being arranged as a third pen assembly and a fourth pen assembly so as to lay down ink along a second diagonal line with respect to the feed path so that an upstream-most cartridge of the third pen assembly includes a nozzle that overlaps a nozzle of a downstream-most cartridge of the fourth pen assembly to span across the web, wherein the width of the web is at least 17 inches;

a roller directs the feed path to turn between the first array and the second array, wherein the second array is located vertically offset to the first array such that the first side is non-contacted along a predetermined distance of the feed path downstream of the first array so as to allow printing provided by the first array to dry; and a controller that tracks movement of the web along the feed path and that directs predetermined of the pens to print in registration with tracking of the web as the web is directed downstream along the feed path.

2. The system as set forth in claim 1 wherein at least one of the first array and the second array includes at least two assemblies of a plurality of the ink jet pens, each of the assemblies being arranged in a side-by side manner.

3. The system as set forth in claim 1 wherein the feed path defines an approximate 180-degree turn between the first array and the second array and the second array is located on a level that is vertically beneath the first array.

4. The system as set forth in claim 3 further comprising a vacuum feed surface that maintains the web in close proximity thereto adjacent to each of the first array and the second array.

5. The system as set forth in claim 1 wherein each array includes a manifold assembly that receives bulk ink from an ink source and directs the ink under a predetermined pressure to each of the pens via a respective feed tube.

6. The system as set forth in claim 5 wherein the pens are arranged in imager units having a self-capping, self-cleaning base.

7. The system as set forth in claim 6 wherein each of the imager units supports three pens therein.

8. The system as set forth in claim 1 further comprising a plurality of movable, spot-printing pens arranged along the feed path adjacent to at least one of the first array and the second array.

9. The system as set forth in claim 8 wherein the movable, spot printing pens are arranged in movable, spot-printing imager units arranged with at least three of the pens located therein, and each of the movable, spot-printing imager units being slidably mounted on a rail assembly so as to be adjustably positioned with respect to a width of the web.

10. The system as set forth in claim 7 wherein the pens of the imager units share a common data link, the link configured to provide a signal for print synchronization to the pens of the imager units from the controller.

11. The system as set forth in claim 10 wherein the common data link provides a print data to control the laying down of ink patterns and a clock data to control timing of the printing in registration with tracking of the web.

12. The system as set forth in claim 6 wherein the imager units further comprise a transport mechanism with a base that selectively uncovers the nozzle of the pens in the imager units.

13. The system as set forth in claim 1 wherein the first array of ink jet pens and the second array of ink jet pens fixedly located on the feed path are mounted on a block that pivotally moves the arrays out of the feed path.

14. The system as set forth in claim 6 wherein the self-capping, self-cleaning base comprises an elastomeric surface configured to move against a seal to seal the nozzle while slidably cleaning the nozzle.

* * * * *